US009354570B2

(12) United States Patent
Arimoto et al.

(10) Patent No.: US 9,354,570 B2
(45) Date of Patent: May 31, 2016

(54) HEATER AND IMAGE HEATING APPARATUS INCLUDING THE SAME

(71) Applicant: CANON KABUSHIKI KAISHA, Tokyo (JP)

(72) Inventors: Kota Arimoto, Kashiwa (JP); Toshinori Nakayama, Kashiwa (JP); Shigeaki Takada, Abiko (JP); Masayuki Tamaki, Abiko (JP); Naoki Akiyama, Toride (JP); Akeshi Asaka, Kashiwa (JP); Koichi Kakubari, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/857,086

(22) Filed: Sep. 17, 2015

(65) Prior Publication Data

US 2016/0085189 A1 Mar. 24, 2016

(30) Foreign Application Priority Data

Sep. 19, 2014 (JP) ..... 2014-191456

(51) Int. Cl.
*G03G 15/20* (2006.01)

(52) U.S. Cl.
CPC ..... *G03G 15/2053* (2013.01)

(58) Field of Classification Search
CPC ..... G03G 15/2057; G03G 15/2053; H05B 3/0014; H05B 3/04; H05B 3/06
See application file for complete search history.

(56) References Cited

U.S. PATENT DOCUMENTS 6,330,014 B1 12/2001 Arauchi et al.
7,200,354 B2 4/2007 Nakamoto et al.
7,203,438 B2 4/2007 Omata et al.
7,260,351 B2 8/2007 Nakayama
7,263,303 B2 8/2007 Nakayama
(Continued)

FOREIGN PATENT DOCUMENTS

JP 6-250539 A 9/1994
JP 2001-1561 1/2001
(Continued)

OTHER PUBLICATIONS

U.S. Appl. No. 14/718,672, filed May 21, 2015.
(Continued)

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

A heater includes a substrate, electrode portions, electrical contact portions, heat generating portions, and electroconductive line portions. The electrode portions include first group electrode portions and second group electrode portions. The electroconductive line portions include a main line portion extending from the electrical contact portions in the longitudinal direction, a first branch line portion branching from the main line portion so as to electrically connect with a first electrode portion of the first group electrode portions, and a second branch line portion branching from the main line portion so as to electrically connect with a second electrode portion of the first group electrode portions. The second electrode portion is spaced farther from the electrical contact portions than the first electrode portion in the longitudinal direction, and the electric resistance of the first branch line portion is larger than the electric resistance of the second branch line portion.

34 Claims, 17 Drawing Sheets

(56) References Cited

U.S. PATENT DOCUMENTS

| | | | | |
|---|---|---|---|---|
| 7,343,130 | B2 | 3/2008 | Nakayama | |
| 7,430,392 | B2 | 9/2008 | Ito et al. | |
| 7,457,576 | B2 | 11/2008 | Takada et al. | |
| 7,460,821 | B2 | 12/2008 | Ai et al. | |
| 7,466,950 | B2 | 12/2008 | Matsuura et al. | |
| 7,505,724 | B2 | 3/2009 | Nakayama | |
| 7,536,145 | B2 | 5/2009 | Tomine et al. | |
| 7,561,818 | B2 | 7/2009 | Arimoto et al. | |
| 7,590,366 | B2 | 9/2009 | Nakayama | |
| 7,596,348 | B2 | 9/2009 | Nakamoto et al. | |
| 7,684,724 | B2 | 3/2010 | Arimoto et al. | |
| 7,729,628 | B2 | 6/2010 | Nakayama | |
| 7,764,895 | B2 | 7/2010 | Tomine et al. | |
| 7,844,208 | B2 | 11/2010 | Hayashi et al. | |
| 7,907,861 | B2 | 3/2011 | Nakayama | |
| 7,949,280 | B2 | 5/2011 | Arimoto et al. | |
| 8,145,086 | B2 | 3/2012 | Chiyoda et al. | |
| 8,254,802 | B2 | 8/2012 | Hanashi et al. | |
| 8,301,067 | B2 | 10/2012 | Takada | |
| 8,306,446 | B2 | 11/2012 | Ito et al. | |
| 8,369,765 | B2 | 2/2013 | Arimoto | |
| 8,478,180 | B2 | 7/2013 | Arimoto et al. | |
| 8,559,837 | B2 | 10/2013 | Nakayama | |
| 8,626,048 | B2 | 1/2014 | Arimoto | |
| 8,712,271 | B2 | 4/2014 | Nakayama et al. | |
| 8,750,739 | B2 | 6/2014 | Tamaki et al. | |
| 8,818,222 | B2 | 8/2014 | Tamaki | |
| 8,818,254 | B2 | 8/2014 | Arimoto et al. | |
| 8,867,941 | B2 | 10/2014 | Takada | |
| 8,913,936 | B2 | 12/2014 | Takada et al. | |
| 8,917,999 | B2 | 12/2014 | Takada et al. | |
| 8,918,003 | B2 | 12/2014 | Kawai et al. | |
| 8,929,762 | B2 | 1/2015 | Shinagawa et al. | |
| 8,958,735 | B2 | 2/2015 | Arimoto | |
| 8,971,746 | B2 | 3/2015 | Hasegawa et al. | |
| 8,989,640 | B2 | 3/2015 | Kitagawa et al. | |
| 2003/0029853 | A1* | 2/2003 | Izawa | G03G 15/2053 219/216 |
| 2004/0218950 | A1* | 11/2004 | Gogate | G03G 15/2057 399/329 |
| 2005/0163523 | A1 | 7/2005 | Omata et al. | |
| 2006/0056891 | A1* | 3/2006 | Hashiguchi | G03G 15/2064 399/329 |
| 2006/0157464 | A1* | 7/2006 | Omata | G03G 15/2057 219/216 |
| 2008/0085139 | A1* | 4/2008 | Roof | G03G 15/2053 399/328 |
| 2011/0082260 | A1 | 4/2011 | Omata et al. | |
| 2011/0280596 | A1* | 11/2011 | Shimura | G03G 15/205 399/33 |
| 2012/0118872 | A1* | 5/2012 | Kanba | G03G 15/2053 219/546 |
| 2012/0121306 | A1* | 5/2012 | Shimura | H05B 3/0095 399/329 |
| 2012/0224876 | A1 | 9/2012 | Nakayama et al. | |
| 2013/0026154 | A1* | 1/2013 | Taniguchi | G03G 15/2053 219/385 |
| 2013/0142532 | A1 | 6/2013 | Kitagawa et al. | |
| 2013/0206745 | A1 | 8/2013 | Tanaka et al. | |
| 2013/0299480 | A1 | 11/2013 | Kakubari et al. | |
| 2013/0322897 | A1 | 12/2013 | Yago et al. | |
| 2013/0343790 | A1* | 12/2013 | Shimura | G03G 15/2053 399/329 |
| 2013/0343791 | A1* | 12/2013 | Shimura | G03G 15/2053 399/329 |
| 2014/0064788 | A1* | 3/2014 | Mogi | G02G 15/2053 399/122 |
| 2014/0076878 | A1* | 3/2014 | Shimura | G03G 15/2042 219/216 |
| 2014/0105633 | A1* | 4/2014 | Takahashi | G03G 15/2053 399/90 |
| 2014/0105658 | A1 | 4/2014 | Tamaki | |
| 2014/0112692 | A1 | 4/2014 | Omata et al. | |
| 2014/0294458 | A1* | 10/2014 | Jeon | G03G 15/2053 399/329 |
| 2014/0353303 | A1* | 12/2014 | Fudo | G03G 15/2053 219/481 |
| 2015/0212473 | A1 | 7/2015 | Kitagawa et al. | |

FOREIGN PATENT DOCUMENTS

| | | | | |
|---|---|---|---|---|
| JP | 2005-234540 | A | 9/2005 | |
| JP | 2009-103881 | | 5/2009 | |
| JP | WO 2015151905 | A1 * | 10/2015 | H05B 3/0095 |

OTHER PUBLICATIONS

U.S. Appl. No. 14/718,557, filed May 21, 2015.
U.S. Appl. No. 14/719,497, filed May 22, 2015.
U.S. Appl. No. 14/719,474, filed May 22, 2015.
U.S. Appl. No. 14/794,869, filed Jul. 9, 2015.
U.S. Appl. No. 14/799,123, filed Jul. 14, 2015.
U.S. Appl. No. 14/799,056, filed Jul. 14, 2015.
U.S. Appl. No. 14/844,249, filed Sep. 3, 2015.

* cited by examiner (a)

(b)

HEATER AND IMAGE HEATING APPARATUS INCLUDING THE SAME

FIELD OF THE INVENTION AND RELATED ART

The present invention relates to a heater for heating an image on a sheet and an image heating apparatus including the heater. The image heating apparatus is usable with an image forming apparatus such as a copying machine, a printer, a facsimile machine, a multifunction machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is proposed (Japanese Laid-open Patent Application (JP-A) Hei 6-250539) these days in which a heat generating element (heater) is contacted to an inner surface of a thin flexible belt to apply heat to the belt. Such a fixing device is advantageous in that the structure has a low thermal capacity, and therefore, the temperature rise for the fixing can be performed quickly.

JP-A Hei 6-250539 discloses a heater including a plurality of electrodes arranged in a longitudinal direction of a substrate so as to connect with heat generating elements extending along the longitudinal direction of the substrate. This heater also includes electroconductor lines extending along the longitudinal direction of the substrate in each of one end side and the other end side of the substrate with respect to a widthwise direction with the heat generating elements as a central portion. These heat generating elements are provided with a plurality of the branch portions with respect to a longitudinal direction of the substrate in order to be connected with a plurality of electrodes provided and arranged in the longitudinal direction of the substrate. Here, the electrodes connected to the electroconductor lines in one end side with respect to a widthwise direction of the substrate and the electrodes connected to the electroconductor lines with respect to the widthwise direction of the substrate are in an alternately arranged relationship with respect to the longitudinal direction of the substrate. For that reason, when a voltage is applied between two electroconductor lines in one end side with respect to the longitudinal direction of the substrate, a potential difference is generated between the adjacent electrodes, so that an energized heat generating element generates heat.

The electroconductor lines thus used have a not insubstantial resistance, so that the voltage applied between the electroconductor lines in one end side of the substrate decreases toward the other end side of the substrate. For that reason, the potential of each of the electrodes is a different value depending on the branch position of the electroconductor line connected with the electrode. Therefore, the heater for supplying electric power (energy) to the heat generating elements using the electroconductor lines described above is liable to have a lower heat generation amount in one end side than in the other end side in the longitudinal direction. In the case where the heat generation amount of the heater is different with respect to the longitudinal direction, there is a risk that an image defect, such as uneven glossiness, is caused to be generated during fixing of the image on a sheet.

Accordingly, the heater in which electroconductor lines extending from an end portion with respect to a longitudinal direction are branched and electric power is supplied to heat generating elements as disclosed in Japanese Laid-Open Patent Application Hei 6-250539 may desirably be such that a temperature non-uniformity due to a voltage drop by an electroconductor line resistance with respect to the longitudinal direction is suppressed.

SUMMARY OF THE INVENTION

A principal object of the present invention is to provide a heater with suppressed heat generation non-uniformity.

Another object of the present invention is to provide an image heating apparatus including the heater that suppresses the tendency to decrease the lifetime thereof.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises: a substrate; a plurality of electrode portions provided on the substrate and arranged with gaps in a longitudinal direction of the substrate; a plurality of electrical contact portions provided on the substrate and electrically connectable with the energy supplying portion; and a plurality of heat generating portions provided between adjacent ones of the electrode portions so as to electrically connect between adjacent electrode portion. The portions, the heat generating portions are capable of generating heat by the electric power supply between adjacent electrode portions. The apparatus also comprises a plurality of electroconductive line portions provided on the substrate and connecting with the electrical contact portions and the electrode portions so that the electrode portions includes first group electrode portions which are connectable with the first terminal and second group electrode portions which are connectable with the second terminal. The first group electrode portions and the second group electrode portions being arranged alternately in the longitudinal direction. The plurality of electroconductive line portions comprise, a main line portion provided on the substrate and extending from the electrical contact portions in the longitudinal direction, a first branch line portion provided on the substrate and branching from the main line portion so as to electrically connect with a first electrode portion of the first group electrode portions, and a second branch line portion provided on the substrate and branching from the main line portion so as to electrically connect with a second electrode portion of the first group electrode portions. The second electrode portion is spaced farther from the electrical contact portions than the first electrode portion in the longitudinal direction, and the electric resistance of the first branch line portion is larger than the electric resistance of the second branch line portion.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

Embodiment 1

Image Forming Portion

Figure 1:
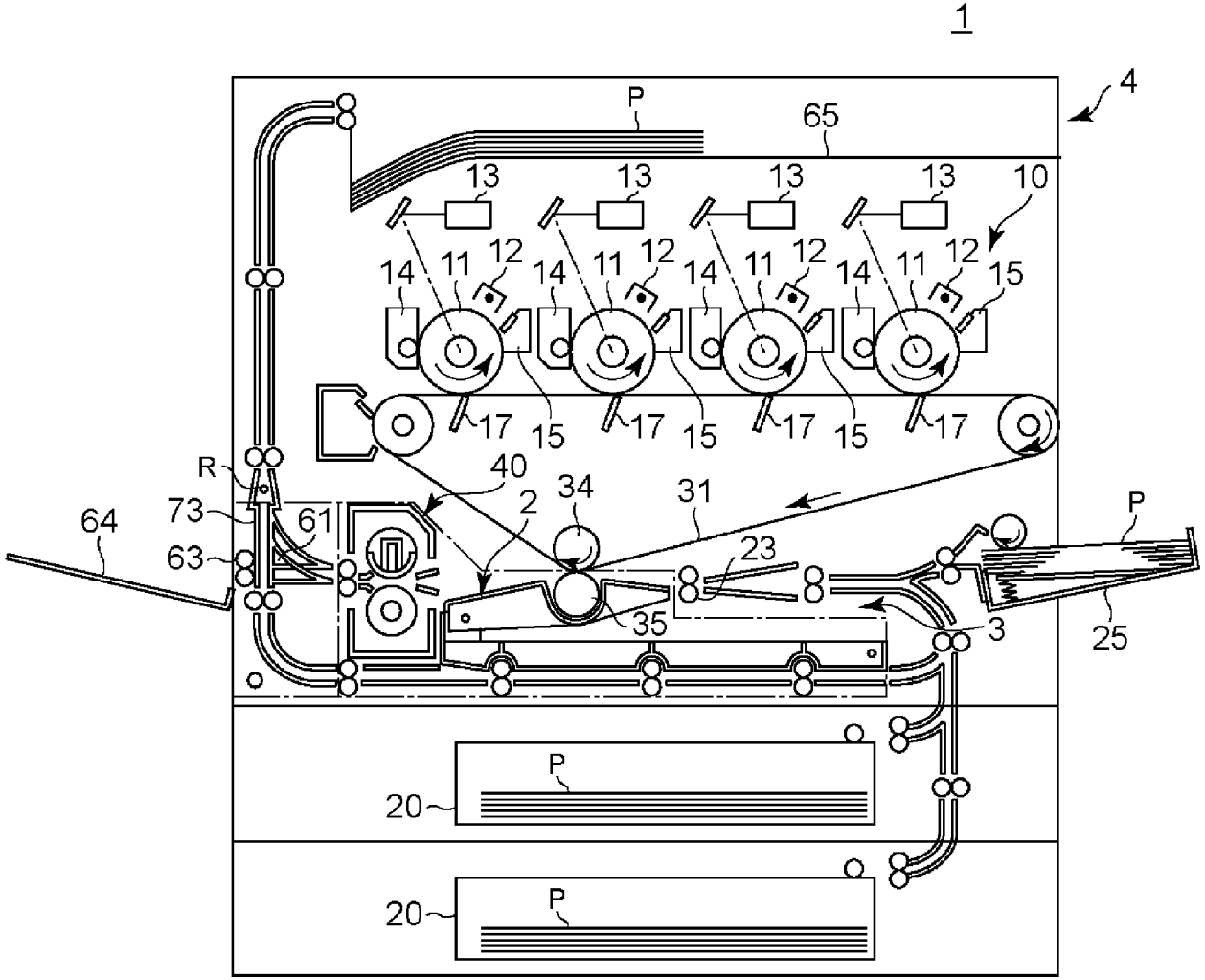
FIG. 1 is a sectional view for illustrating a structure of an image forming apparatus according to Embodiment 1 of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 for yellow, magenta, cyan, and black include respective photosensitive drums 11 corresponding to Y, M, C, Bk colors, which are arranged in the order named from the left side. Around each drum 11, similar elements are provided as follows: a charger 12; an exposure device 13; a developing device; a primary transfer blade 17; and a cleaner 15. The structure for the Bk toner image formation will be described as a representative, and the descriptions for the other colors are omitted for simplicity by assigning them like reference numerals. So, the elements will be simply called photosensitive drum 11, charger 12, exposure device 13, developing device 14, primary transfer blade 17 and cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation operation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P are plain paper, thick sheet, resin material sheet, overhead projector film and the like. The pair of registration rollers 23 once stops the sheet P for correcting oblique feeding. The registration rollers 23 then feed the sheet P into the space between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
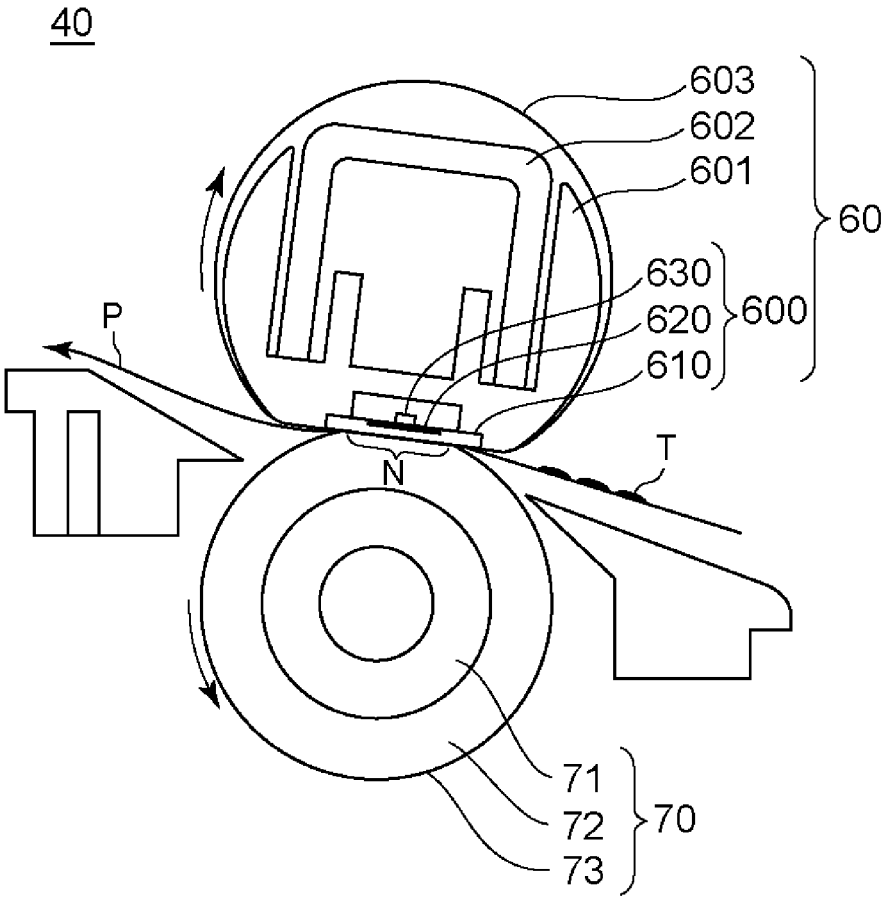
FIG. 2 is a sectional view for illustrating a structure of a fixing device in Embodiment 1.
Figure 3:
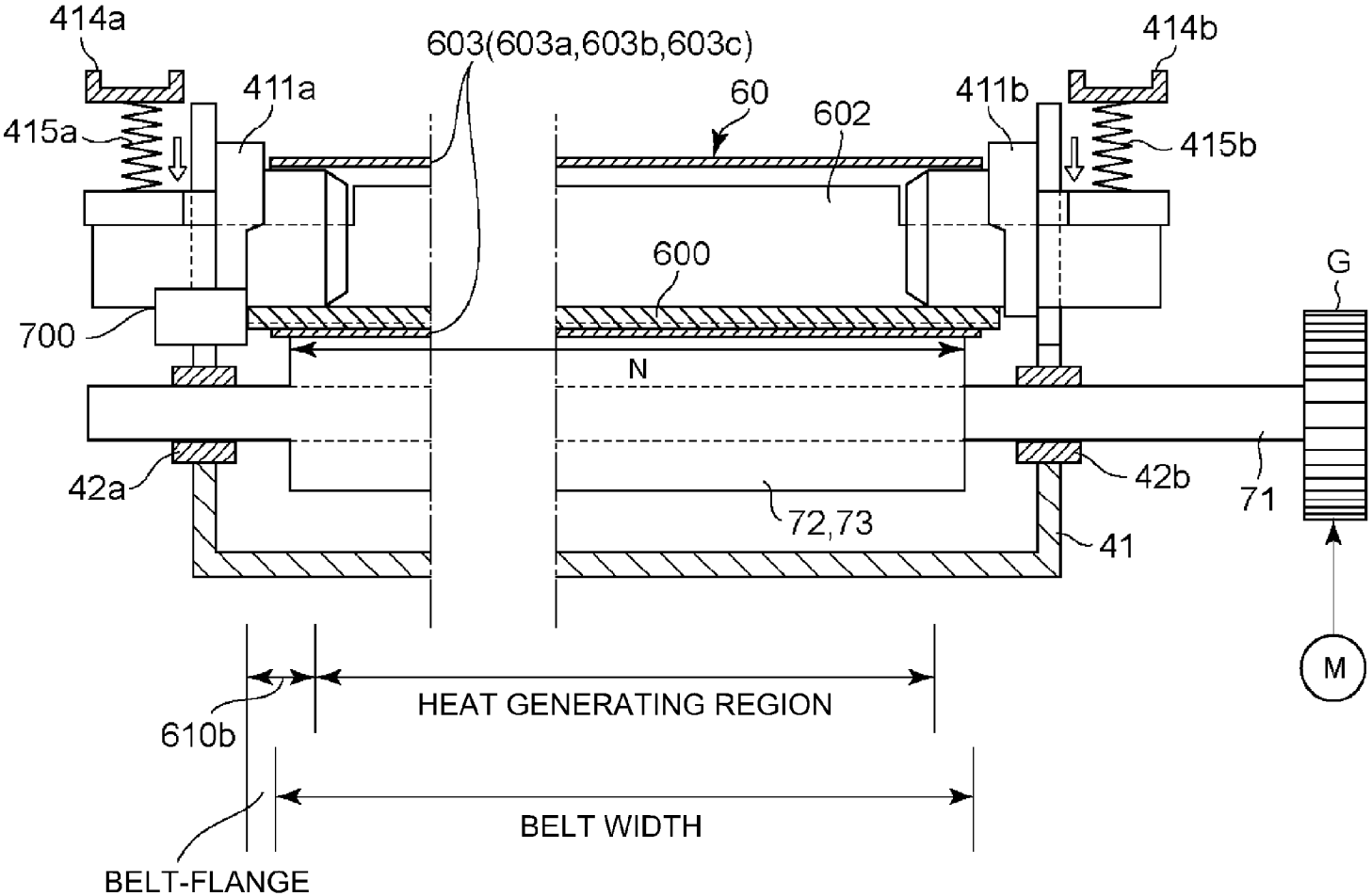
FIG. 3 is a front view for illustrating the structure of the fixing device in Embodiment 1.
Figure 4:
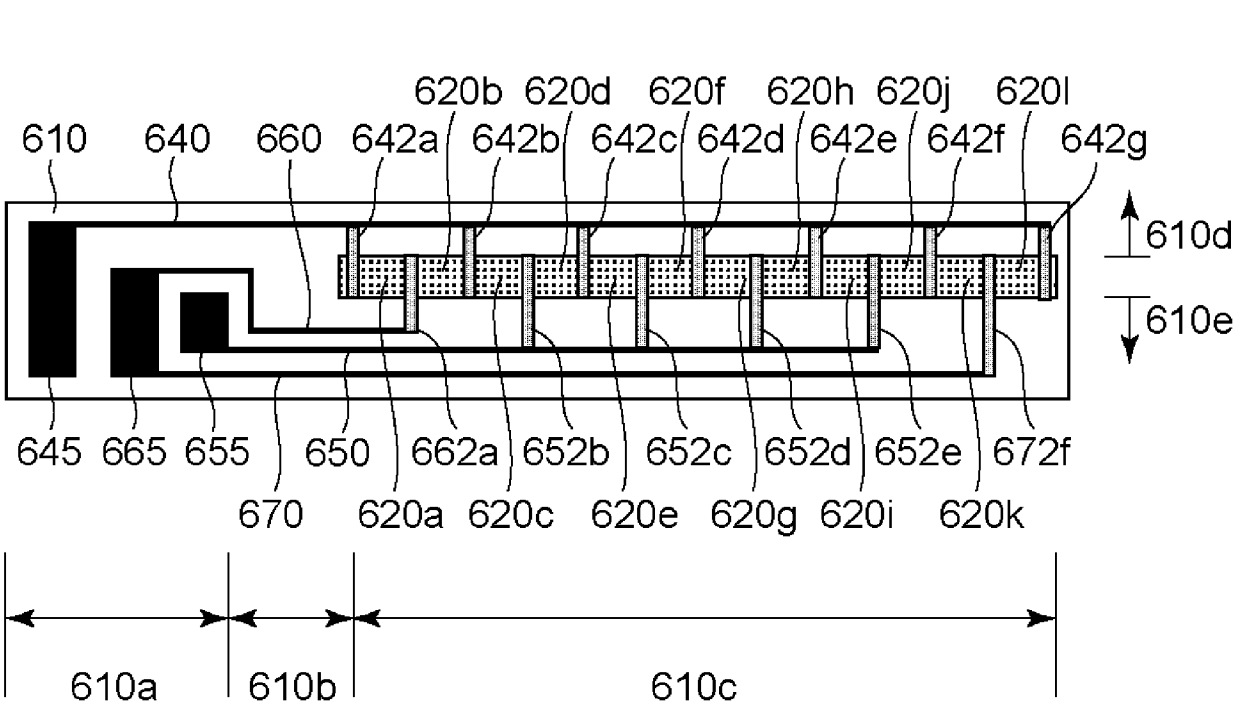
FIG. 4 is a schematic view for illustrating a structure of a heater in Embodiment 1.
Figure 5:
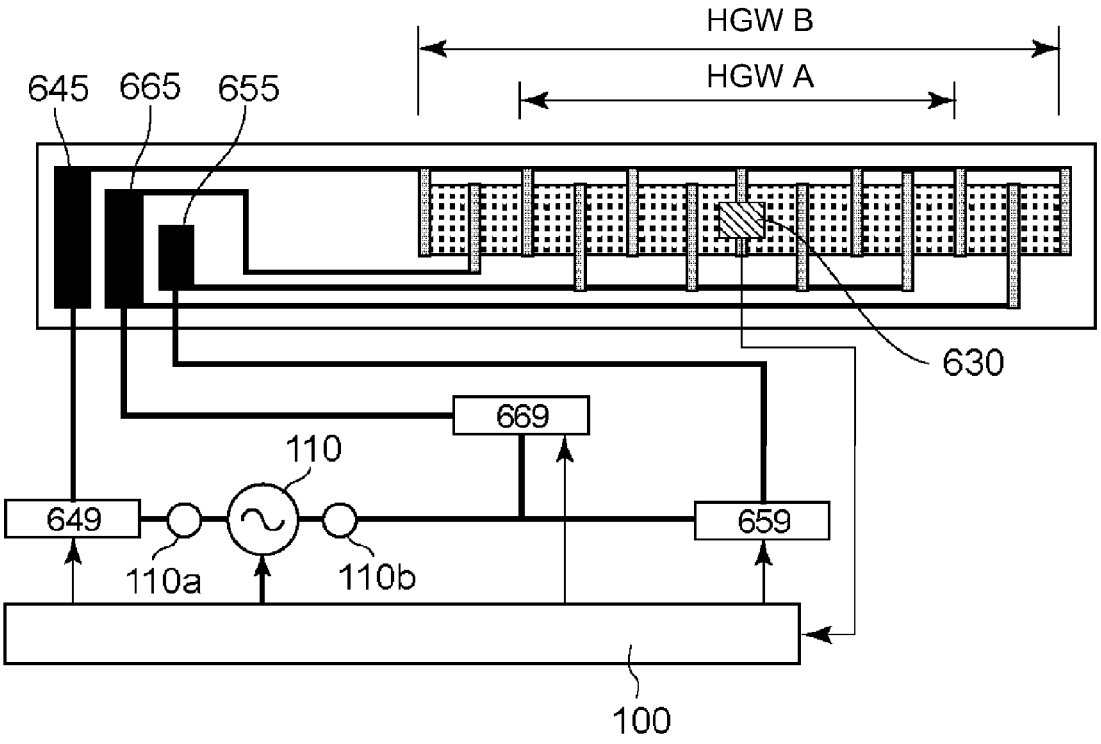
FIG. 5 is a schematic view for illustrating a structural relationship of the fixing device in Embodiment 1.

The fixing device 40 will be described. FIG. 2 is a sectional view for illustrating a structure of the fixing device 40. FIG. 3 is a front view for illustrating a structure of the fixing device 40. FIG. 4 is a schematic view for illustrating a structure of a heater 600. FIG. 5 is a schematic view for illustrating a structural relationship of the fixing device 40.

The fixing device 40 is an image heating apparatus for heating the image on the sheet by a belt unit 60 (unit 60). The unit 60 has a structure in which a flexible thin fixing belt 603 is heated by the heater 600 contacted to the inner surface of the belt 603. Therefore, the fixing device 40 can efficiently heat the fixing belt 603, so that the fixing device is excellent in rising performance during the fixing operation. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat generated from the heater 600 is supplied to the sheet P through the belt 603, so that the toner image T is formed on the sheet P.

The unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a member for heating the belt 603, slidably contacting the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the up-down direction in FIG. 4), 350-400 mm in the length (the dimension as measured in the left-right direction in FIG. 4), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620) as a heat generating layer.

The belt 603 is a cylindrical (endless) belt (film) for heating the image on the sheet in the nip N. In this embodiment as the belt 603, a belt prepared by forming on a base material 603*a*, an elastic layer 603*b* and a parting layer 603*c*. Specifically, as the base material 603*a*, a cylindrical member, which is 30 mm in outer diameter and 340 mm in length and 30 μm the thickness and which is formed of a nickel alloy, is used. Further, on the base material 603*a*, as the elastic layer 603*b*, a silicone rubber layer having a thickness of 400 μm is formed, and on the elastic layer 603*b*, as a parting layer 603*c*, fluorine resin tube having a thickness of 20 μm is coated.

A heater holder 601 (holder 601) functions to hold the heater 600 in the state of urging the heater 600 toward the inner surface of the belt 603. The holder 601 has a semi-arcuate cross-sectional shape (the surface of FIG. 2) and functions to regulate the rotation orbit of the belt 603. The holder 601 may be made of heat-resistant resin material or the like. In this embodiment, it is Zenite 7755 (trade name) available from Dupont.

The support stay 602 is a member for supporting the heater 600 by way of the holder 601. The support stay 602 is preferably made of a material that is not easily deformed even when a large load is applied thereto, and in this embodiment, it is made of SUS304 (stainless steel).

As shown in FIG. 3, the support stay 602 is supported by left and right flanges 411*a* and 411*b* at the opposite end portions thereof with respect to the longitudinal direction. The flanges 411*a* and 411*b* may be simply called the flange 411. The flange 411 regulates the movement of the belt 603 in the longitudinal direction and the circumferential direction configuration of the belt 603. The flange 411 is made of heat resistive resin material or the like. In this embodiment, PPS (polyphenylenesulfide resin material) is used.

Between the flange 411 and a pressing arm 414, an urging spring 415 is provided in a compressed state. With such a structure, an elastic force of the urging spring 415 is applied to the heater 600 through the flange 411 and the support stay 602. The fixing belt 603 is pressed against the pressing roller 70 at a predetermined urging force to form the nip N having a predetermined nip width. In this embodiment, the pressure is 156.8 N (16 kgf) at one end portion side and 313.6 N (32 kgf) in total.

A connector 700 is an electric energy supply member electrically connected with the heater 600 for applying a voltage to the heater 600. The connector 700 is detachably provided at one longitudinal end portion of the heater 600.

As shown in FIG. 2, the roller 70 is a nip forming member which contacts an outer surface of the belt 603 to cooperate with the belt 603 to form the nip N. The roller 70 has a multi-layer structure in which an elastic layer 72 is provided on a metal core 71 of a metal material and a parting layer 73 is provided on the elastic layer 72. As the metal core 71, stainless steel, SUM (sulfur and sulfur-containing free-machining steel), and aluminum can be used. As the elastic layer 72, a silicone rubber layer, a sponge rubber layer or an elastic foam rubber layer can be used. As the parting layer 73, a fluorine-containing resin material can be used.

The roller 70 in this embodiment includes a metal core 71 of stainless steel, an elastic layer 72 of silicone rubber foam, and a parting layer 73 of fluorine-containing resin tube. The roller 70 is 25 mm in outer diameter, and 330 mm in length.

As shown in FIG. 3, the metal core 71 of the roller is rotatably held by a side plate 41 via bearings 42*a*, 42*b*. At one end portion of the metal core 71, a gear G is provided and transmits a driving force of a motor M to the metal core 71. The pressing roller 70 driven by the motor M is rotationally driven in an arrow direction (clockwise, FIG. 2) and transmits the driving force to the fixing belt 603 at the nip N, so that the fixing belt 603 is rotated by the rotational drive of the pressing roller 70. In this embodiment, the motor M is controlled by a control circuit 100 so that a sheet speed of the pressing roller 70 is 200 mm/sec.

A thermistor 630 shown in FIG. 5 is a temperature sensor provided on a back side of the heater 600, for detecting the temperature of the heater 600. The thermistor 630 is connected with the control circuit 100 through an A/D converter (unshown) and feeds an output corresponding to the detected temperature to the control circuit 100.

The control circuit 100 is a circuit including a CPU for operating various controls, and a non-volatile medium such as a ROM. Programs are stored in the ROM, and the CPU reads and executes them to effect the various controls. The control circuit 100 is electrically connected with a voltage source 110 so as to control electric power supply (energization) from the voltage source 110.

The control circuit 100 uses the temperature information acquired from the thermistor 630 for the electric power supply control for the voltage source 110. More particularly, the control circuit 100 controls the electric power supplied to the heater 600 on the basis of the output of the thermistor 630. In this embodiment, a type in which the control circuit 100 carries out wave number control of the output of the voltage source 110 to adjust the amount of heat generation of the heater 600 is used, so that when the toner image is fixed on the sheet, the heater 600 is maintained at a predetermined temperature.

[Heater]

Figure 6:
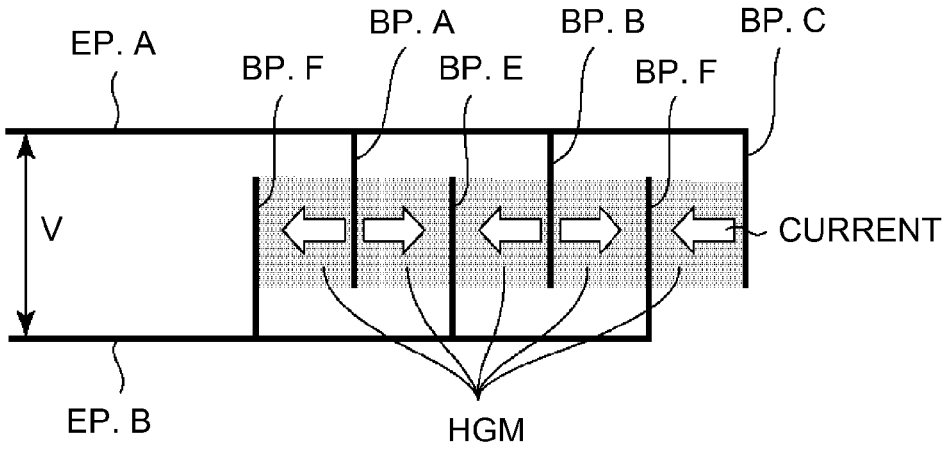
In FIG. 6, (a) illustrates an energization type for a heater, and (b) illustrates a switching system for an energization region of the heater.
Figure 6:
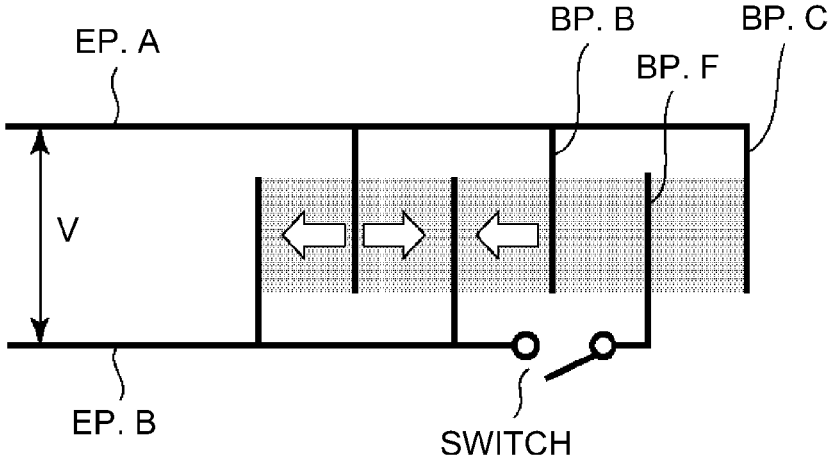

The structure of the heater 600 used in the fixing device 40 will be described in detail. In FIG. 6, (a) illustrates an energization type of the heater 600, and (b) illustrates an energization region switching type used with the heater 600. The heater 600 of this embodiment is a heater using the energization type shown in (a) and (b) of FIG. 6.

In the illustrations of the heat generation (energization) type shown in FIG. 6, each of electroconductor paths and branch paths is an electroconductive pattern (electroconductor line). Branch paths ("BP.") branch from an electroconductor path A ("EP. A"), and branch paths ("BP.") F branch from an electroconductor path B ("EP. B"). The branch paths branching from the electroconductor path A and the branch paths branching from the electroconductor path B are alternately arranged along the longitudinal direction (left-right direction in (a) of FIG. 6), and heat generating resistors (heat generating elements) are electrically connected between the adjacent branch paths.

When a voltage V is applied between the electroconductive path A and the electroconductive path B, a potential difference is generated between the adjacent branch paths. As a result, as indicated by arrows in (a) of FIG. 6, electric currents flow through the heat generating elements, and the directions of the electric currents through the adjacent heat generating elements are opposite to each other. In this embodiment, the energization to the heater 600 is effected in the above-described manner. As shown in (b) of FIG. 6, between the electroconductive path B and the branch path F, a switch or the like is provided, and when the switch is opened, the branch path B and the branch path C are at the same potential, and therefore, no electric current flows through the heat generating element therebetween. In other words, by disconnecting a part of the electroconductor path electrically, only a part of the heat generating element can be caused to generate heat. In this embodiment, the heat generating region of the heat generating element 620 can be changed using the above-described system (type).

In the case that the electric power is supplied individually to the plurality of heat generating elements arranged in the longitudinal direction, it is preferable that the branch paths are disposed so that the directions of the electric current flow alternate between adjacent heat generating elements as described above. As another method of supplying the electric power to the plurality of heat generating elements arranged in the longitudinal direction, it would be considered to arrange the heat generating elements each connected with the branch paths having different polarities at the longitudinal ends thereof, in the longitudinal direction, and the electric power is supplied in the same direction along the longitudinal direction. However, with such an arrangement, two branch paths are required to be provided between adjacent heat generating elements, and therefore there is the risk of generating a short circuit between these branch paths. In addition, the number of required branch paths is large, with the result of a large non-heat generating portion between the heat generating elements. Therefore, it is preferable to arrange the heat generating elements and the branch paths such that a branch path is made common between adjacent heat generating elements. With such an arrangement, the risk of generating a short circuit between the branch paths can be avoided, and the space between the branch paths can be eliminated.

In this embodiment, an electroconductive path 640 shown in FIG. 4 corresponds to the electroconductive path A of (a) of FIG. 6, and electroconductive paths 650, 660, 670 (FIG. 4) correspond to the electroconductive path B ((a) of FIG. 6). In addition, common branch paths 652*a*-652*g* (FIG. 4) correspond to branch paths A-C ((a) of FIG. 6), and opposite branch paths 652*b*-652*e*, 662*a*, 672*f* (FIG. 4) correspond to branch paths D-F ((a) of FIG. 6). Heat generating elements 620*a*-620*l* (FIG. 4) correspond to the heat generating elements of (a) of FIG. 6. Hereinafter, the common branch paths 642*a*-642*g* are collectively referred to as a branch path 642. The opposite branch paths 652*b*-652*f* are collectively referred to as a branch path 652. The opposite branch path 662*a* is referred to as a branch path 662. The opposite branch path 672*f* is referred to as a branch path 672. The heat generating elements 620*a*-620*l* are collectively referred to as a heat generating element 620. The structure of the heater 600 will be described in detail referring to the accompanying drawings.

As shown in FIGS. 4 and 6, the heater 600 comprises the substrate 610, the heat generating element 620 formed on the substrate 610, an electroconductor patterns (640, 650, 660, 670, 642, 652, 662, 672), electrical contacts (645, 655, 665) and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of 400 mm, a width (up-down direction in FIG. 4) of 8.0 mm and a thickness of 1 mm. The alumina plate member is 30 W/m·K in thermal conductivity.

On the substrate 610, the heat generating element 620 and the electroconductor pattern are formed by a screen printing method. In this embodiment, as a material for the electroconductor pattern, a low resistivity material such as a silver paste or an alloy paste of silver mixed with palladium in a small amount is used. As a material for the heat generating element 620, a silver-palladium alloy paste mixed to provide a desired resistance value is used. Incidentally, as another material for the heat generating element 620, it is possible to use ruthenium oxide.

Electrical contacts 645, 655, 665 electrically connected with the voltage source 110 are provided in one end portion side 610*a* of the substrate 610 with respect to the longitudinal direction. In addition, there are provided the heat generating element 620 and the branch paths (642, 652, 662, 672). The branch paths electrically connect the electroconductor paths 640, 650, 660, 670 with the associated heat generating elements 620, respectively. The heat generating element 620 and the electroconductor pattern are coated with the insulating coating layer of heat-resistant glass, and are electrically protected so as not to generate a leakage and a short circuit.

The heat generating element 620 (620*a*-620*l*) is a resistor capable of generating joule heat by electric power supply (energization). The heat generating element 620 is one heat generating element (member) extending in the longitudinal direction on the substrate 610. The heat generating element 620 in this embodiment has a width (measured in the widthwise direction of the substrate 610) of 3.0 mm, a thickness of 20 μm, and a longitudinal length is 320 mm, in which an entire region of the A4-sized sheet P (297 mm in width) can be heated. The total resistance of the heat generating element 620 is 10 Ω.

On the heat generating element 620, seven common branch paths 642*a*-642 *g* are laminated at regular intervals with respect to the longitudinal direction of the substrate 610. In other words, the heat generating element 620 is partitioned into six sections by the branch paths 642*a*-642 *g* along the longitudinal direction. The length of each section of the heat generating element 620 is 53.3 mm. On central portions of the respective sections of the heat generating element 620, the six opposite branch paths 662*a*, 652 (652*b*-652*e*), 672 are laminated. In this manner, the heat generating element 620 is divided into 12 sub-sections 620*a*-620*l* as a plurality of heat generating elements, each positioned between adjacent electrodes. The length of each sub-section is 26.7 mm. The resistance value of each sub-section is 120 Ω.

The resistivity of each of the branch paths 642, 652, 662, 672 is remarkably smaller than the resistivity of the heat generating element 620. For that reason, at a position where branch paths laminate (overlap with each other), the current flowing through the heat generating element 620 becomes small, so that the degree of the heat generation decreases. For that reason, when the width (longitudinal length) of the branch path is large, a temperature non-uniformity is generated with respect to the longitudinal direction of the heater 600 and the fixing belt 603. When the sheet P is subjected to the fixing process, due to the temperature non-uniformity of the fixing belt 603, there is a risk that the glossiness of the image on the sheet P becomes non-uniform. This phenomenon results from a lowering in glossiness of the toner by failure in sufficient heating and melting of the toner on the sheet due to a lowering in temperature of the fixing belt 603 at a portion opposing the branch path. Therefore, as a result of study by the present inventors on this problem, it was discovered that the non-uniformity of the glossiness is slight when the width of the branch path is 1.0 mm or less and is not generated when the width of the branch path is 0.5 mm or less. Accordingly, in this embodiment, the upper limit of the branch path is set at 0.5 mm.

The branch paths 642, 652, 662, 672 are a part of the above-described electroconductor pattern. The branch paths 642, 652, 662, 672 are provided along the widthwise direction of the substrate 610 so as to be perpendicular to the longitudinal direction of the heat generating element 620. The branch paths in this embodiment are formed of the same material and with the same width in the entire region thereof. The branch paths 642, 652, 662, 672 are partly provided on the substrate 610 and are partly provided on the heat generating element 620 so that the electroconductor paths 640, 650, 660, 670 described later are electrically connected with the heat generating element 620. In this embodiment, of the branch path, a portion having an overlapping positional relationship with the heat generating element is referred to as an electrode portion.

In this embodiment, of the branch paths connected with the heat generating element 620, odd-numbered branch paths from one longitudinal end of the heat generating element 620 are common branch paths 642, and even-numbered branch paths from the one longitudinal end of the heat generating element 620 are opposite branch paths 652, 662, 672.

That is, the common branch paths and the opposite branch paths are arranged alternately with a predetermined interval with respect to the longitudinal direction of the heat generating element 620.

In the above description, of the plurality of branch paths, the odd-numbered branch paths from the one longitudinal end of the heat generating element 620 and the common branch paths, and the even-numbered branch paths are the opposite branch paths, but the heater is not limited to this constitution. A similar effect can be obtained also in the case where of the plurality of branch paths, the even-numbered branch paths from the one longitudinal end of the heat generating element 620 are the common branch paths, and the odd-numbered branch paths are the opposite branch paths.

The branch path 642 is connected with a terminal 110*a* of the voltage source 110 in one end side via the electroconductor path 640 and the like described later. That is, the branch path 642 is connected with one terminal side of the voltage source 110.

The branch path 652 is connected with a terminal 110*b* of the voltage source 110 in the other end side via the electroconductor path 650 described later. The branch path 662 is connected with the other end side terminal 110*b* of the voltage source 110 via the electroconductor path 660 described later. The branch path 672 is connected with the other end side terminal 110*b* of the voltage source 110 via the electroconductor path 670 described later. That is, the branch paths 652, 662, 672 are connected with the other end side terminal of the voltage source 110.

The electroconductor paths 640, 650, 660, 670 are a part of the above-described electroconductor pattern, and are electric power supplying lines for connecting electrical contacts with the respective branch paths in order to supply the electric power to the heat generating element.

The electroconductor path 640 is formed along the longitudinal direction of the substrate 610 in one (widthwise) end side 610*d* of the substrate 610 with respect to the heat generating element 620. The electroconductor path 640 is connected with the branch paths 642 in one end side and is connected with the electrical contact 645 in the other end side. That is, the electroconductor path 640 extends from the electrical contact 645 along the longitudinal direction of the heater.

Similarly, the electroconductor paths 650, 660, 670 are formed along the longitudinal direction of the substrate 610 in the other (widthwise) end side 610*e* of the substrate 610 with respect to the heat generating element 620. The electroconductor path 640 is connected with the branch paths 652 (652*b*-652*e*) in one end side and is connected with the electrical contact 655 in the other end side. That is, the electroconductor path 650 extends from the electrical contact 655 along the longitudinal direction of the heater. Further, the electroconductor paths 660, 670 are connected with the branch paths 662*a*, 672*f*, respectively, and is connected with the electrical contact 665 in the other end side. That is, the electroconductor paths 660, 670 extends from the electrical contact 665 in the longitudinal direction of the heater. Here, the electroconductor paths and the branch paths function as an electroconductor line portion.

The electrical contacts 645, 655, 665 are provided in parallel with each other in one longitudinal end side so as to be positioned outside a region where the heater 600 contacts the fixing belt 603. Here, the electrical contact 645 functions as one electrical contact portion, and the electrical contacts 655, 665 function as the other electrical contact portion.

The electrical contacts 645, 655, 665 are in an exposed state that the electrical contacts are not coated with the insulating coating layer, and are electrically connectable with the connecter 700. As described above, in the heater 600 in this embodiment, the voltage source 110 and the heat generating elements 620 are electrically connected with each other via the connector, the electrical contacts, the electroconductor paths and the branch paths.

[Connector]

Figure 7:
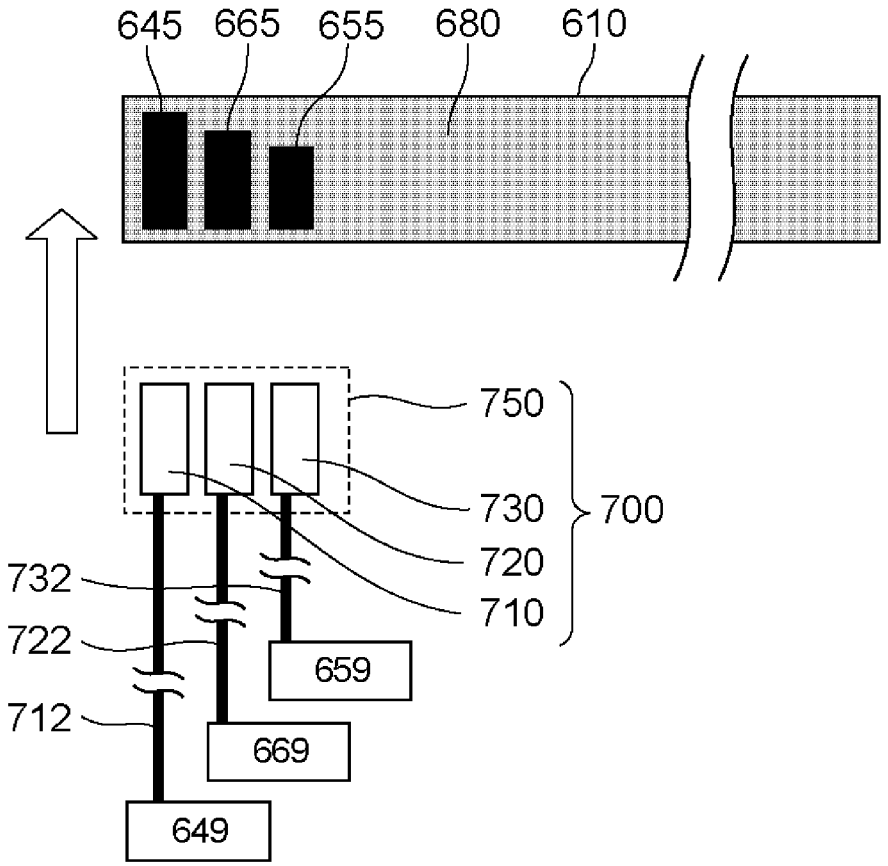
FIG. 7 is a schematic view for illustrating a connector in Embodiment 1.

The connector 700 used with the fixing device 40 will be described in detail. FIG. 7 is an illustration of the connector 700. The connector 700 in this embodiment includes contact terminals 710, 720, 730. The connector 700 is electrically connected with the heater 600 by mounting to the heater 600. The connector 700 comprises a terminal 710 electrically connectable with the electrical contact 645, and a terminal 720 electrically connectable with the electrical contact 665. The connector 700 also comprises a terminal 730 electrically connectable with the electrical contact 655. The connector 700 comprises a housing 750 for integrally holding the terminals 710, 720, 730. The connector 700 sandwiches a region of the heater 600 extending out of the belt 603 with respect to the longitudinal direction so as not to contact the belt 603, by which the terminals are electrically connected with the electrical contacts, respectively. In the fixing device 40 of this embodiment having the above-described constitution, no soldering or the like is used for the electrical connection between the connectors and the electrical contacts. Therefore, the electrical connection between the heater 600 and the connector 700 which rise in temperature during the fixing process operation can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 7, the connector 700 provided with the metal terminals 710, 720, 730 is mounted to the heater 600 in the widthwise direction of the substrate 610 at one end portion side 610*a* of the substrate. The terminal 710 is connected with a switch A649 by a cable 712. The terminal 710 has a channel-like configuration, and by moving in the direction indicated by an arrow in FIG. 7, it can receive the heater 600 can be inserted into a gap portion of the channel-like configuration. Therefore, the contact 710 sandwiches the heater 600 between the front and back sides to fix the position of the heater 600.

Similarly, the terminal 720 is a member for electrically connecting the electrical contact 665 with a switch C669 described later. The terminal 720 is connected with the switch C669 by a cable 722.

Similarly, the terminal 730 is a member for electrically connecting the electrical contact 655 with a switch B659 described later. The terminal 730 is connected with the switch B659 by a cable 732.

As shown in FIG. 7, the terminals 710, 720, 730 of metal are integrally supported on the housing 750 of resin material. The terminals 710, 720, 730 are provided in the housing 750 with spaces between adjacent ones so as to be connected with the electrical contacts 645, 661*a*, 651, respectively when the connector 700 is mounted to the heater 600. Between adjacent contact terminals, partitions are provided to electrically insulate the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. FIG. 5 is a schematic view for illustrating a relationship among constituent elements of the fixing device 40.

The fixing device 40 of this embodiment is capable of changing the width of the heat generating region of the heater 600 by controlling the electric energy supply to the heater 600 depending on the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extends from the center portion. The electric energy supply to the heater 600 will be described in conjunction with the accompanying drawings.

First, the voltage source 110 is a circuit for supplying the electric power to the heater 600. In this embodiment, the commercial voltage source (AC voltage source) of 100V in effective value (single phase AC) is used. The voltage source 110 of this embodiment is provided with a voltage source contact 110*a* and a voltage source contact 110*b* having different electric potentials. The voltage source 110 may be DC voltage source if it has a function of supplying the electric power to the heater 600.

The control circuit 100 is electrically connected with the switch A649, the switch B659, and the switch C669, respectively to control the switch A649, the switch B659, and the switch C669, respectively. The switch A649 is a switch (relay) provided between the voltage source contact 110*a* and the electrical contact 641, and connects or disconnects between the voltage source contact 110*a* and the electrical contact 641 depending on the instructions from the control circuit 100. The switch B659 is a switch provided between the voltage source contact 110*b* and the electrical contact 655, and connects or disconnects between the voltage source contact 110*b* and the electrical contact 655 depending on the instructions from the control circuit 100. Similarly, the switch C669 is a switch provided between the voltage source contact 110*b* and the electrical contact 665, and connects or disconnects between the voltage source contact 110*b* and the electrical contact 665 depending on the instructions from the control circuit 100.

When the control circuit 100 receives the execution instructions of a job, the control circuit 100 acquires the width size information of the sheet P to be subjected to the fixing process. In accordance with the width size information of the sheet P, the switch A649, the switch B659, and the switch C669 are switched ON and OFF, so that the width size of the heat generation region of the heat generating element 620 is suitable for the fixing process of the sheet P. In this embodiment, the control circuit 100, the voltage source 110, the switches 649, 659, 669 function as an electric energy supplying means.

Next, a method of changing the heat generation region of the heat generating element 620 depending on the size of the sheet P with respect to the widthwise direction will be specifically described.

First, in the case where the sheet P has a large size such as an A4-landscape size (widthwise size: 297 mm), the control circuit 100 effects control so that the heat generating element 620 generates heat with a heat generation width B. Specifically, all the switches, switch A649, the switch B659 and the switch C669, are placed in an ON state, so that the electric power (energy) is supplied to the heater 600. At this time, all of the 12 sub-sections 620*a*-620*l* of the heat generating element 620 generate heat. That is, the width of the heat generation region is 320 mm and is a suitable width for performing the fixing process of the toner image on the sheet P having the A4-landscape size.

Next, in the case where the sheet P has a small size such as A4-portrait size (widthwise size: 210 mm) of the sheet P, the control circuit 100 effects control so that the heat generating element 620 generates heat with a heat generation width A. Specifically, the switch A649 and the switch B659 are placed in an ON state and the switch C669 is placed in an OFF state, so that the electric power (energy) is supplied to the heater 600 under these conditions. At this time, of the 12 sub-sections, 8 sub-sections 620*c*-620*j* of the heat generating element 620 generate heat. That is, the width of the heat generation region is 213 mm and is a suitable width for performing the fixing process of the toner image on the sheet P having the A4-portrait size.

The fixing device 40 is capable of changing the width size of the heater in the heat generation region depending on the width size of the sheet P, and therefore the temperature rise of the heater 600 in a non-passing region of the sheet P can be suppressed. In addition, by suppressing the heat generation in the non-passing region of the sheet P, it is possible to suppress the waste of electric power.

[Resistance of Branch Path]

The resistances of the branch paths 642, 652, 662, 672 will be described.

In this embodiment, in order to suppress the electric power consumption, as a material for these branch paths, a paste material principally comprising silver having low resistivity is used. However, these electroconductor paths have a not insubstantial resistance, and therefore an applied voltage is described depending on the path length of the electroconductor path.

The resistance Ra of the electroconductor path from the electrical contact to the branch path is calculated from the following formula. In the formula, the width of the electroconductor path is Wa (widthwise direction of the substrate 610), the height is Ha, the resistivity is ρa, and the distance from the electrical contact to the branch path is La.

$$Ra=\rho a\times La/(Wa\times Ha) \quad (1)$$

That is, it is understood that the resistance value Ra becomes large in proportional to the distance from the electrical contact to the branch path.

The resistance Rb from the contact point of the branch path with the electroconductor path to a terminal is calculated from the following formula, in which, the width (longitudinal direction of the substrate 610) of the branch path is Wb, the height is Hb, the resistivity is ρb, and the length of the branch path is Lb.

$$Rb=\rho b\times Lb(Wb\times Hb) \quad (2)$$

Accordingly, the total resistance Rall, which is a resistance from the electrical contact to an end portion (terminal) of the branch path, is calculated from the following formula.

$$Rall=Ra+Rb=\rho a\times La/(Wa\times Ha)+\rho b\times Lb/(Wb\times Hb) \quad (3)$$

That is, the total resistance Rall is larger with the path having a larger distance from the point to the heat generating element. Accordingly, the voltage applied to the electroconductor path 640 decreases with distance from the electrical contact 645. For that reason, in the case where if all of the resistances of the branch paths 642 are the same, the voltage applied from the branch paths 642 to the heat generating element 620 becomes smaller with a decreasing distance from the other end with respect to the longitudinal direction of the substrate 610. Similarly, the voltage applied to the electroconductor path 650 decreases with distance from the electrical contact 655, and the voltage applied to the electroconductor paths 660, 670 decreases with distance from the electrical contact 665. For that reason, in the case where if all of the resistances of the branch paths 652, 662, 672 are the same, the voltages applied from the branch paths 652, 662, 672 to the heat generating element 620 become smaller with a decreasing distance from the other end with respect to the longitudinal direction of the substrate 610.

Accordingly, the heat generation amount of every section of the heat generating element 620 when the voltage is applied to the heater 600 gradually decreases with an increasing distance from one end, i.e., a decreasing distance to the other end with respect to the longitudinal direction of the substrate. That is, the heat generation amount of the heat generating element 620*a* located at a position closest to the electrical contact is largest, and the heat generation amount of the heat generating element 610*l* located at a position remotest from the electrical contact is smallest. For that reason, the belt 603 heated by the heater 600 is higher in temperature toward one end side (a contact side of the heater 600 with the electrical contact) and is lower in temperature toward the other end side (a side opposite from the contact side).

Therefore, in this embodiment, the resistance of every branch path is changed so that the voltages applied to the respective sections of the heat generating element 620 becomes uniform. That is, the resistance of each branch path is adjusted so that the total resistance from each of the electrical contacts to the associated one of the branch paths of the heat generating element 620 is the same for any path. Specifically, in this embodiment, the resistance of each branch path is adjusted by changing the branch path width of every branch path. In this embodiment, in order to further enhance an effect of resistance adjustment to vary the resistance depending on the width of the branch path, as a material for the branch path, a material having a higher resistivity than the electroconductor path is used.

By the above-described constitution, in the respective electric power supplying paths using the branch paths 642 (642*a*-642*g*) of the heater 600, the values of the total resistance Rall are substantially the same. Further, in the respective electric power supplying paths using the branch paths 652 (652*b*-652*f*), 662*a*, 672*g* of the heater 600, the values of the total resistance Rall are substantially the same. For that reason, in this embodiment, it is possible to uniformly apply the voltage to the respective sections of the heat generating element 620, so that the heat generation amounts of the respective sections of the heat generating element can be made substantially equal. This will be described specifically using the drawings.

Figure 8:
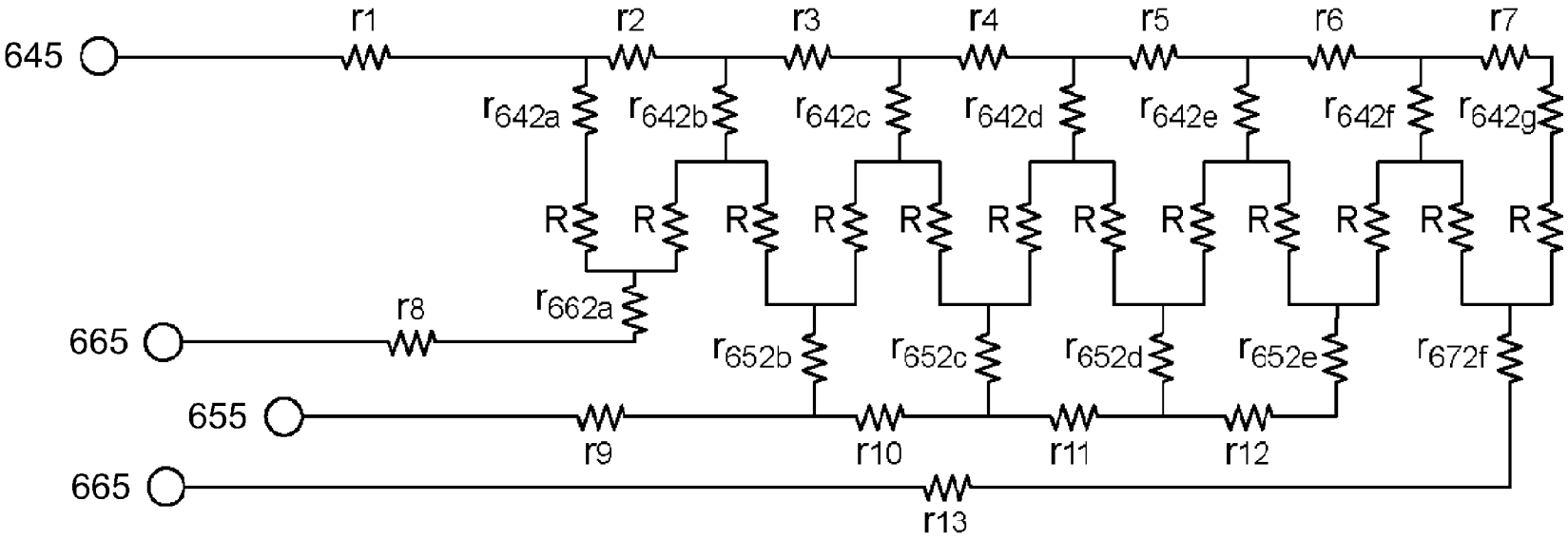
FIG. 8 is a schematic view for illustrating a resistance distribution of the heater in Embodiment 1.

FIG. 8 is a schematic view for illustrating the resistance distribution of the heater 600. In FIG. 8, resistors R represent resistors of the respective heat generating elements 620*a*-620*l*. Further, resistors r1-r7 represent resistors of the electroconductor path 640. Specifically, the resistor of the electroconductor path 640 extending from the electrical contact 645 to branch to the branch path 642*a* is r1. The resistor of the electroconductor path 640 from a branch point to the branch path 642*a* until the electroconductor path 640 branches to the branch path 642*b* is r2. That is, the resistor between the branch path 642*a* and the branch path 642*b* is r2. Hereinafter, the respective resistors of the electroconductor path 640 will be similarly described. The resistor between the branch path 642*b* and the branch path 642*c* is r3. The resistor between the branch path 642*c* and the branch path 642*d* is r4. The resistor between the branch path 642*d* and the branch path 642*e* is r5. The resistor between the branch path 642*e* and the branch path 642*f* is r6. The resistor between the branch path 642*f* and the branch path 642*g* is r7.

The resistor r8 represents a resistor of the electroconductor path 660. Further, resistors r9-r12 represent resistors of the electroconductor path 650. Specifically, the resistor of the electroconductor path 660 extending from the electrical contact 665 to branch to the branch path 652*b* is r8. The resistor of the electroconductor path 650 extending from the electrical contact 655 to the branch path 652*a* is r9. Further, in the electroconductor path 650, the resistor of the electroconductor line between the branch path 652*b* and the branch path 652*c* is r10. The resistor of the electroconductor line between the branch path 652*c* and the branch path 652*d* is r11. The resistor of the electroconductor line between the branch path 652*d* and the branch path 652*e* is r12.

The resistor r13 represents a resistor of the electroconductor path 670. A resistor r642*a* represents a resistor of the branch path 642*a*. Similarly, resistors r642*b*-r642*g* represent resistors of the branch paths 642*b*-642*g*, respectively. The resistor r662*a* represents a resistor of the branch path 662*a*. Resistors r652*b*-r652*e* represent resistors of the branch paths 652*b*-652*e*, respectively. The resistor r672*f* represents a resistor of the branch path 672*f*.

According to FIG. 8, it can be said that each of the branch paths is connected with the associated electrical contact via the associated resistor of the associated electroconductor path. Values of resistances of the paths (electroconductor paths) between the branch paths and the electrical contacts are shown in Table 1. In this embodiment, the width Wa of each of the electroconductor paths 640, 650, 660, 670 is 0.7 mm, and the height Ha is 35 μm. In this embodiment, the material for the respective electroconductor paths is a paste in which silver is mixed with palladium so that the resistivity ρa is $1.6\times10^{-8}$ (Ω).

TABLE 1

| BP*1 | Path (EP*2) | PL*3 Lb1 [mm] | PR*4 Rb1 [Ω] |
|---|---|---|---|
| 642a | r1 | 100 | 0.14 |
| 642b | r1 + r2 | 153 | 0.22 |

TABLE 1-continued

| BP*1 | Path (EP*2) | PL*3 Lb1 [mm] | PR*4 Rb1 [Ω] |
|---|---|---|---|
| 642c | r1 + r2 + r3 | 206 | 0.29 |
| 642d | r1 + r2 + r3 + r4 | 260 | 0.36 |
| 642e | r1 + r2 + r3 + r4 + r5 | 313 | 0.44 |
| 642f | r1 + r2 + r3 + r4 + r5 + r6 | 366 | 0.52 |
| 642g | r1 + r2 + r3 + r4 + r5 + r6 + r7 | 420 | 0.59 |
| 662a | r8 | 127 | 0.18 |
| 652b | r9 | 180 | 0.25 |
| 652c | r9 + r10 | 233 | 0.33 |
| 652d | r9 + r10 + r11 | 287 | 0.40 |
| 652e | r9 + r10 + r11 + r12 | 340 | 0.48 |
| 672f | r13 | 393 | 0.55 |

*1: "BP" is the branch path.
*2: "EP" is the electroconductor path.
*3: "PL" is a path length.
*4: "PR" is a path resistance.

According to Table 1, it is understood that the magnitude of the resistance (path resistance) between the electrical contact and the branch path varies depending on the respective branch paths. This is attributable to the difference in length of the path between the electrical contact and the branch path. The difference in resistance for each of the paths leads to a difference in voltage drops for each of the paths, and therefore the difference in path resistance causes the energization non-uniformity of the heat generating element 620, so that there is a risk that a heat generation non-uniformity of the heat generating element 620 is caused to be generated.

Therefore, in this embodiment, the resistance of each branch path is adjusted so that the voltage applied to the associated section of the heat generating element becomes uniform. Specifically, the width Wb of the branch path short in path length is made narrow and the width Wb of the branch path long in path length is made broad so that values of the total resistance from the electrical contacts to terminals (end points) of the branch paths are the same for any path.

For example, the resistance of the branch path 642*a*, which is an example of a first branch line, is larger than the resistance of the branch path 642*g*, which is an example of a second branch line. Further, the resistance of the branch path 652*b*, which is an example of a third branch line, is larger than the resistance of the branch path 652*e*, which is an example of a fourth branch line.

Further, the width of the branch path 642*a*, which is an example of a first branch line, is broader than the width of the branch path 642*g*, which is an example of a second branch line. Further, the width of the branch path 652*b*, which is an example of a third branch line, is broader than the width of the branch path 652*e*, which is an example of a fourth branch line.

In this embodiment, a high-resistivity material is used for the branch paths so that the resistivity ρb of each branch path is higher than the resistivity ρa of the associated electroconductor path. By employing such a constitution, enlargement in size of the branch path is suppressed. With this, the heat generation non-uniformity of the heater 600 and the belt 603 with respect to the longitudinal direction due to lamination between the heat generating element and the branch paths is suppressed. As described above, in order to satisfy the requirement of uniformity in glossiness of the image, the width of the branch paths may desirably be 0.5 mm or less. Further, from the viewpoint of a limit in manufacturing accuracy in the screen printing, the width of the branch paths may desirably be 0.1 mm or more.

Therefore, the selection of the materials is made so that the width of the branch path 642*a* for which the largest resistance is required and the width of the branch path 642*g* for which the smallest resistance is required, fall within the above-described range. For that reason, as the material for the branch paths, the material is selected that has a larger resistivity than the material for the electroconductor paths. In this embodiment, as the material for the branch paths, a paste in which silver is mixed with palladium so that the resistivity thereof is $2.8\times10^{-7}\Omega\cdot m$, which is about 17.5 times the resistivity ρa of the electroconductor paths, is used. The height Hb of each branch path is 35 μm, which is equal to that of the height Ha of each electroconductor path. Constitutions of the respective branch paths based on the above description in this embodiment are shown in Table 2. In Table 2, the resistance 1 represents the resistance of the branch path resistances, of a portion that is not in contact with the heat generating element 620. Further, the resistance 2 represents a resistance, of the branch path resistances, of a portion (energization layer) that is in contact with the heat generating element 620.

TABLE 2

| | Width Wb (mm) | Length Lb (mm) | Resistance (Ω) | Resistance (Ω) |
|---|---|---|---|---|
| 642a | 0.100 | 3.3 | 0.051 | 0.512 |
| 642b | 0.115 | 3.3 | 0.455 | 0.445 |
| 642c | 0.135 | 3.3 | 0.040 | 0.376 |
| 642d | 0.170 | 3.3 | 0.031 | 0.308 |
| 642e | 0.215 | 3.3 | 0.024 | 0.239 |
| 642f | 0.300 | 3.3 | 0.017 | 0.171 |
| 642g | 0.500 | 3.3 | 0.010 | 0.102 |
| 662a | 0.100 | 3.3 | 0.050 | 0.502 |
| 652b | 0.150 | 4.3 | 0.144 | 0.333 |
| 652c | 0.180 | 4.3 | 0.122 | 0.281 |
| 652d | 0.220 | 4.3 | 0.099 | 0.228 |
| 652e | 0.285 | 4.3 | 0.076 | 0.176 |
| 672f | 0.500 | 5.3 | 0.077 | 0.100 |

Here, in order to verify an effect of this embodiment, a comparison between this embodiment and a Comparison Example is made. In the Comparison Example, all of the branch paths are 0.2 mm in width Wb and 35 μm in height Ha. Further, the branch paths are $1.6\times10^{-8}$ (Ω) in resistivity ρb and are formed of the same material as that for the electroconductor paths.

Figure 9:
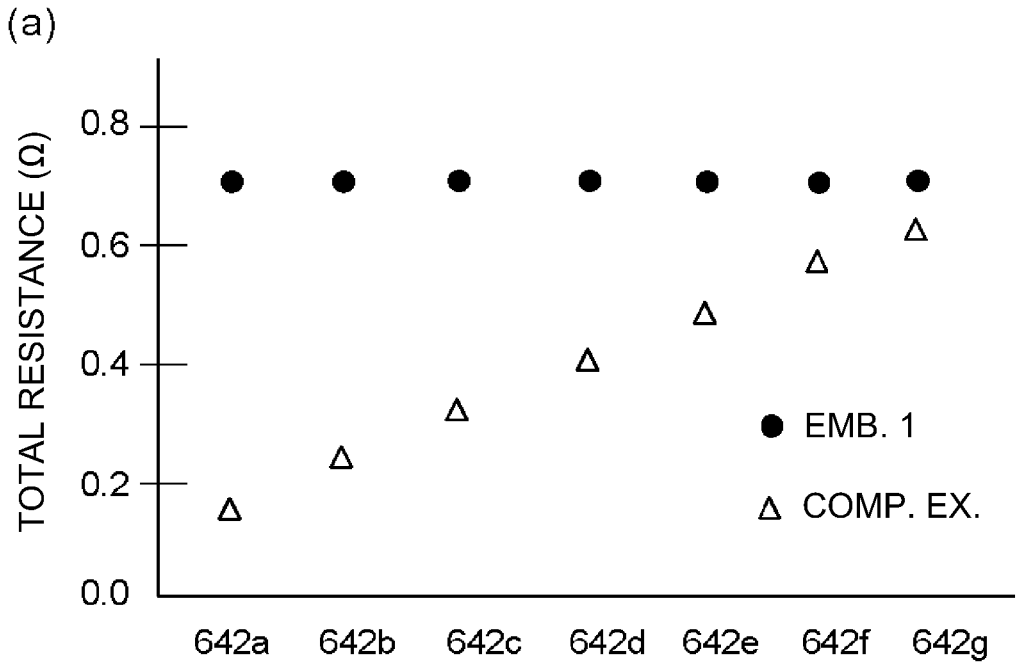
In FIG. 9, (a) is a graph showing a total resistance Rall in a path including a common branch path, and (b) is a graph showing a total resistance Rall in a path including an opposite branch path in Embodiment 1.
Figure 9:
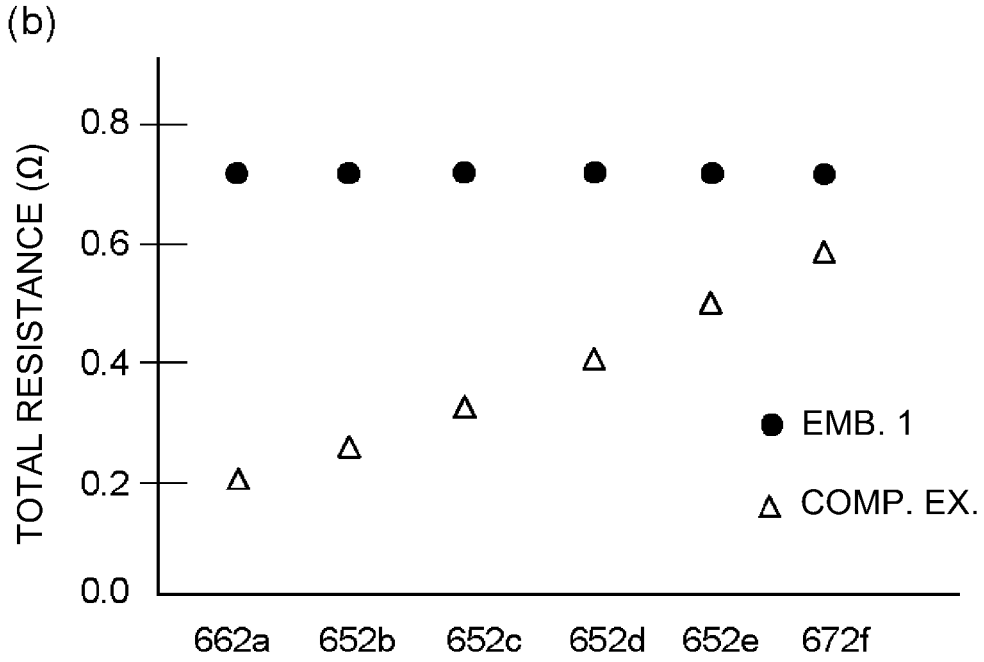

First, between this embodiment and the Comparison Example, the total resistance Rall of the path from the electroconductor path to the heat generating element will be compared. In FIG. 9, (a) is a graph showing the total resistance Rall in the path including the common branch path 642. According to (a) of FIG. 9, it is understood that the total resistance Rall becomes larger as the path including the branch path 642 becomes more remote from the electrical contact. This is attributable to the difference in the resistance value Ra from the electrical contact 645 to the branch path for each of the branch paths. Accordingly, the total resistance Rall becomes larger as the branch path becomes more remote from the electrical contact, and in the case where the voltage is applied to the electrical contact 645, the voltage applied to the heat generating element 620 decreases as the position become more remote from the electrical contact 645.

In FIG. 9, (b) is a graph showing the total resistance Rall in the path including the opposite branch path. According to (b) of FIG. 9, in the case of the Comparison Example, it is understood that the total resistance becomes larger as the branch path, of the branch paths 652, 662, 672, becomes more remote from the electrical contact. Incidentally, in this case, the electroconductor paths 650, 660, 670 were formed to have the same width, the same height and the same resistivity. For that reason, in the case where the same voltage is applied to the electrical contact 655 and the electrical contact 665, the applied voltage decreases as the position of the heat generating element 620 becomes more remote from the electrical contact 655 and the electrical contact 665.

On the other hand, in this embodiment, as the material for the branch path, the material having a larger resistivity than the material for the electroconductor path is used, and the width of the branch path is made narrower with a position closer to the electrical contact. For that reason, as shown in (a) of FIG. 9 and (b) of FIG. 9, the values of the total resistance Rall in all of the common branch paths 642 can be uniformized substantially at the same value. Similarly, the values of the total resistance Rall in all of the opposite branch paths can be uniformized substantially at the same value.

Figure 14:
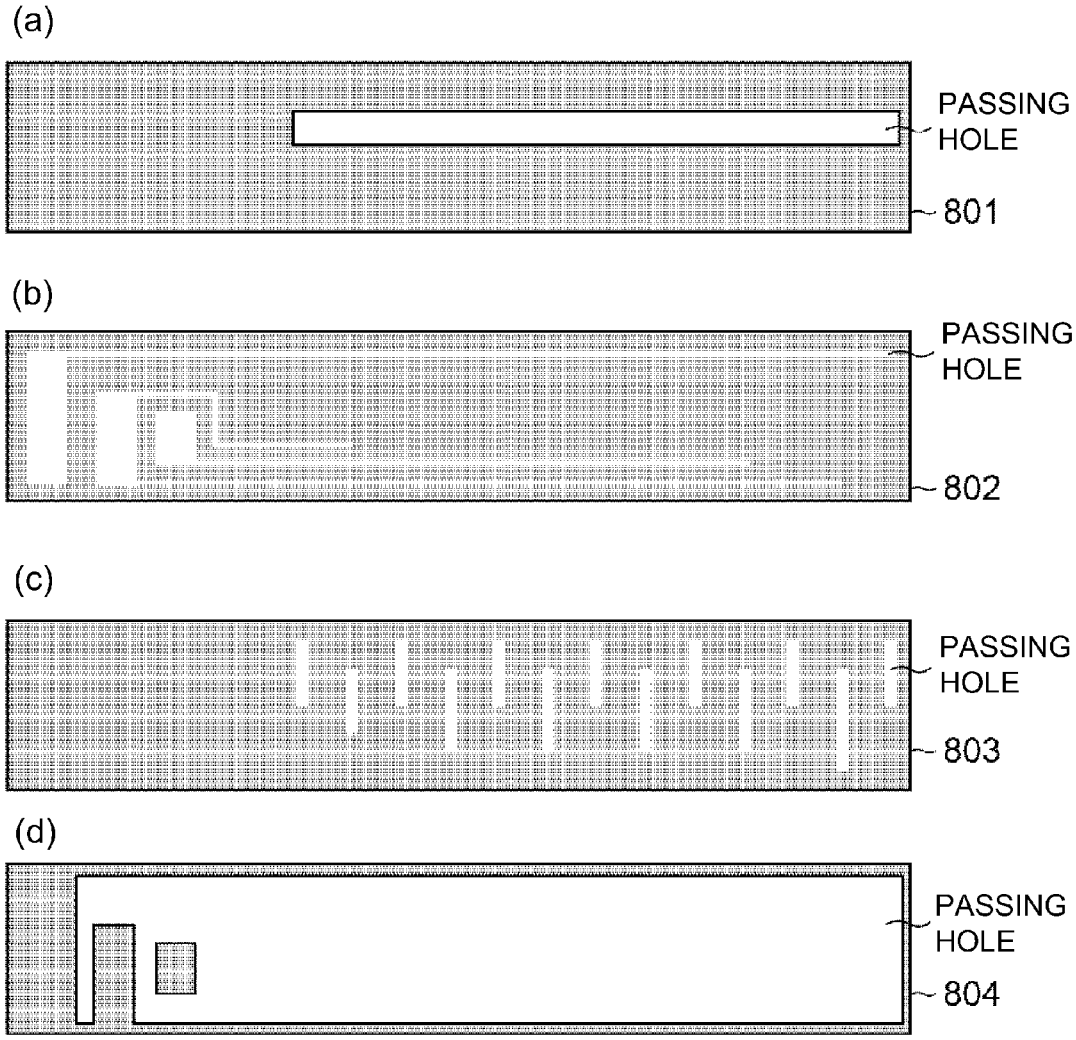
In FIG. 14, (a) to (d) are schematic views showing a plate used for manufacturing the heater in Embodiment 1.
Figure 15:
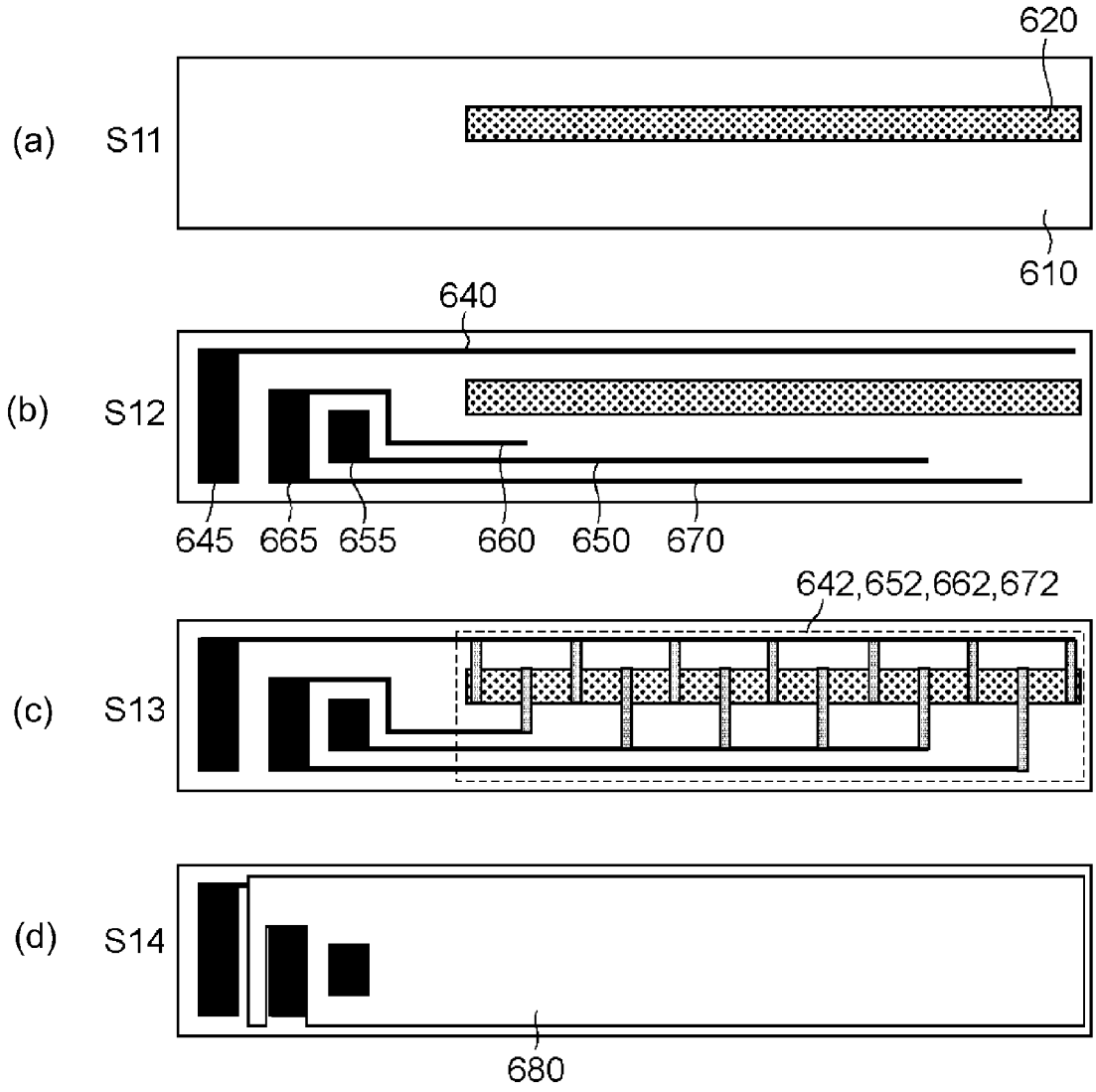
In FIG. 15, (a) to (d) are schematic views for illustrating manufacturing steps of the heater in Embodiment 1.
Figure 16:
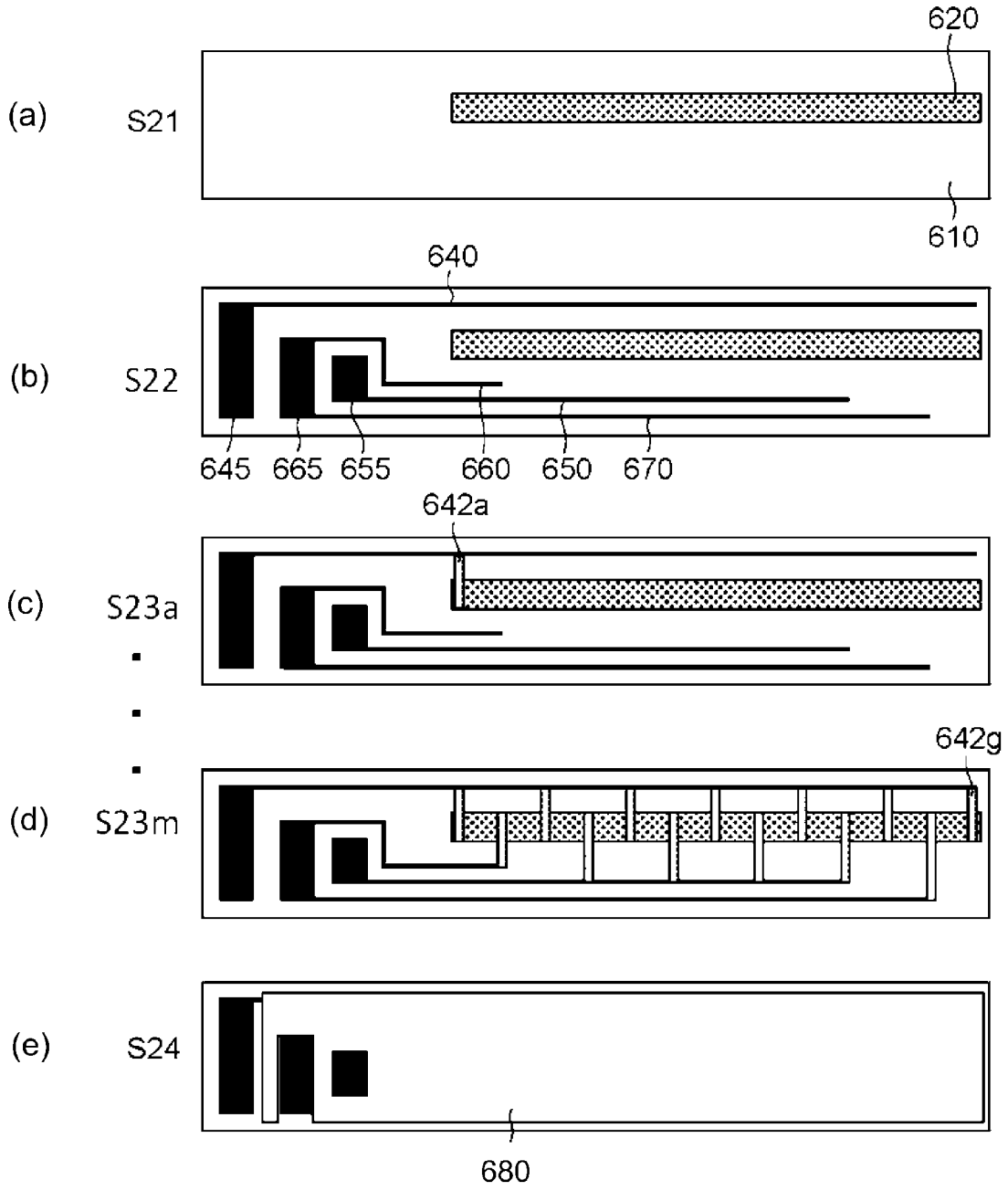
In FIG. 16, (a) to (e) are schematic views for illustrating manufacturing steps of the heater in the modified example.

First, a manufacturing method of a ceramic heater using a thick film printing method (screen printing method) will be described. In FIG. 14, (a) to (d) are schematic views showing structures of plates 801, 802, 803, 804, respectively, used for manufacturing the heater 600 in Embodiment 1. In FIG. 15, (a) to (d) are schematic views for illustrating manufacturing steps of the heater 600 in Embodiment 1. In FIG. 16, (a) to (e) are schematic views for illustrating manufacturing steps of the heater 600 in modified example.

In a step of subjecting the substrate 610 to the screen printing, a plate (mesh plate, metal mask plate, as shown in (a) to (c) of FIG. 14. A plate 801 ((a) of FIG. 14) is a member for printing the heat generating element 620 on the substrate. The plate 801 is provided with a passing hole through which a material paste is passable so that the heat generating element 620 is printed in a desired shape.

A plate 802 ((b) of FIG. 14) is a member for printing, on the substrate, electroconductor patterns such as the electrical contacts 645, 655, 665 and the electroconductor paths 640, 650 660, 670. The plate 802 is provided with passing holes through which a material paste is passable so that the electroconductor pattern is printed in a desired shape. A plate 803 ((c) of FIG. 14) is a member for printing the branch paths 642, 652, 662, 672 on the substrate. The plate 803 is provided with passing holes through which a material paste is passable so that the branch paths 642, 652, 662, 672 are printed in desired shapes. A plate 804 ((d) of FIG. 15) is a member for printing the coat layer 680 on the substrate. The plate 804 is provided with a passing hole through which a material paste is passable so that the coat layer 680 is printed in a desired shape.

In this embodiment, the heater 600 is manufactured by a procedure as shown in FIG. 15. First, the heat generating element 620 is formed on the substrate 610 (S11) ((a) of FIG. 15). Specifically, the substrate 610 and the plate 801 are (positionally) aligned with each other, and thereafter a material paste having a high resistance is applied onto the substrate 610 through the plate 802. Thus, the heat generating element 620 having a desired dimension is printed on the substrate 610. Thereafter, the substrate 610 on which the heat generating element 620 is placed is baked at high temperature. Then, on the substrate 610 on which the heat generating element 620 is formed, electroconductor patterns (645, 655, 665, 640, 650, 660, 670) are formed (S12) ((b) of FIG. 15). Specifically, after alignment between the substrate 610 and the plate 801 is made, the material paste having the low resistance is applied onto the substrate 610 through the plate 801. Thus, the electroconductor pattern having a desired shape is printed on the substrate 610. Thereafter, the substrate 610 on which the heat generating element 620 and the electroconductor pattern are placed is baked at high temperature.

Then, on the substrate 610 on which the above-described electroconductor patterns and the heat generating element are formed, the branch paths 642, 652, 662, 672 are formed (S13) ((c) of FIG. 15). Then, on the substrate 610 on which the various printing steps are performed, an insulating coat layer 680 for effecting electrical, mechanical and chemical protection is formed (S14) ((d) of FIG. 15). Specifically, after alignment between the substrate 610 and the plate 804, a glass paste is applied onto the substrate 610 through the plate 803. Thus, a desired coat layer 680 is printed on the substrate 610. Thereafter, the substrate 610 on which the heat generating element 620, the electroconductor patterns and the coat layer 680 are placed is baked at high temperature.

Incidentally, in this embodiment, after the heat generating element 620 is formed on the substrate 610 (S11), the electroconductor lines are formed on the substrate (S12) and thereon, the branch paths are formed (S13), but the manufacturing procedure of the heater is not limited thereto. For example, the branch paths are formed (S13), the electroconductor lines are formed (S12), and then the heat generating element may also be formed (S11). That is, the steps (S11-S13) may also be in no particular order.

Figure 10:
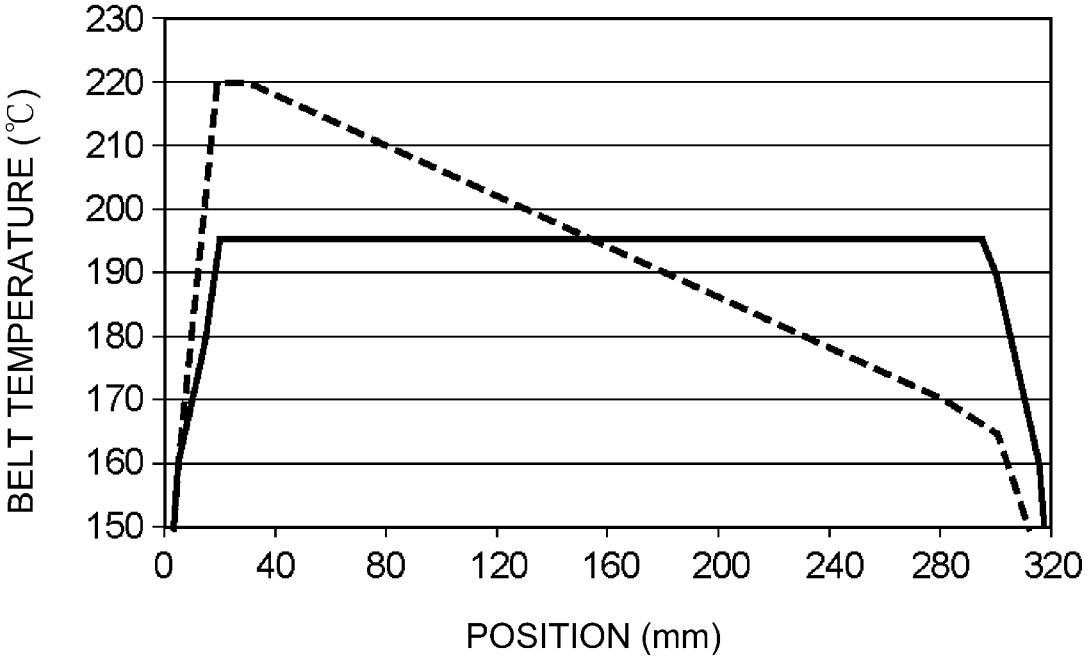
FIG. 10 is a graph for illustrating a temperature distribution of a fixing belt in Embodiment 1.

Next, between this embodiment and the Comparison Example, the temperature distribution of the fixing belt 603 with respect to the longitudinal direction will be compared. FIG. 10 is a graph showing a state of the temperature distribution of the fixing belt. The temperature distribution in the case where the heater 600 in this embodiment is used is indicated by a solid line, and the temperature distribution in the case where the heater in the Comparison Example is used is indicated by a broken line. In FIG. 10, the abscissa includes a point of origin, which is the left end of the heat generating element 620 shown in FIG. 4. In this case, the comparison will be made under a condition in which the temperature of the heater 600 at a longitudinal central portion is maintained at 220° C. by a thermistor 630. At this time, the temperature of the fixing belt at a longitudinal central portion (position of 160 mm in FIG. 10) is maintained at 195° C.

According to FIG. 10, in the case of the Comparison Example, the temperature of the fixing belt 603 is higher in a side closer to the electrical contact of the heater 600 than at the longitudinal central portion, and the highest temperature thereof is 220° C. In the case of the Comparison Example, the temperature of the fixing belt 603 is lower in a side more remote from the electrical contact of the heater 600 than at the longitudinal central portion, and the lowest temperature thereof is 165° C. Accordingly, the fixing belt 603 generates a temperature difference of about 55° C. at a maximum with respect to the longitudinal direction thereof. For that reason, in the case where the image fixing is made using the fixing belt 603 heated by the heater 600 in the Comparison Example, the image subjected to the fixing process generates uneven glossiness with respect to the longitudinal direction.

According to FIG. 10, in the case of this embodiment, the heat generation amounts of the respective sections of the heat generating element 620 of the heater 600 are uniform, and therefore the temperature of the fixing belt 603 is uniform at about 195° C. with respect to the longitudinal direction. For that reason, in the case where the image is fixed using the fixing belt 603 heated by the heater 600 in this embodiment, it is possible to output a high-quality image for which the uneven glossiness is suppressed.

Accordingly, according to this embodiment, it is possible to suppress the non-uniformity of the energization to the heat generating element 620 generated due to the difference in length of the electroconductor path having a resistance. Further, the heat generation non-uniformity of the heater 600 with respect to the longitudinal direction can be suppressed. Accordingly, it is possible to suppress the uneven glossiness of the image when the image on the sheet is heated in the fixing device 40.

In this embodiment, the resistivity of the branch path is made larger than the resistivity of the electroconductor path and the widths of the branch paths are made different from each other, but the method of adjusting the resistances of the branch paths is not limited thereto. If a method is capable of adjusting the branch path resistance, the method may also be used. For example, the branch path resistance may also be adjusted only by a change in width of the branch path, while the resistivity of the branch path and the resistivity of the electroconductor path are kept in an equal state. When this method is used, the branch paths and the electric power supplying lines can be printed in the same step, and therefore the number of steps can be reduced. However, from the viewpoint that the enlargement in size of the branch path can be suppressed, the heater 600 may desirably employ the constitution in this embodiment. Further, from the viewpoint that a local temperature lowering of the heat generating element 620 due to the lamination between the heat generating element 620 and the branch path can be suppressed, the heater 600 may desirably employ the constitution in this embodiment.

For example, the branch resistance may also be adjusted by changing the branch path length. However, in order to increase the branch path length between the heat generating element and the electroconductor path, there is a need to arrange these members so that the branch path detours around these members, so that a large space is required. Accordingly, it is desirable that the heater 600 employs the constitution in this embodiment from the viewpoint that the enlargement in size of the branch path can be suppressed.

For example, a modified example in which the branch path resistance is adjusted by changing the resistivity of the respective branch paths while keeping the width of the branch paths at a constant level may also be used. In FIG. 16, (a) to (e) are schematic views for illustrating the manufacturing steps of the heater 600 in modified example. As shown in (a) to (e) of FIG. 16, the heater 600 in the modified example is manufactured by steps from S21 to S24. In the modified example, in the steps of S23*a* to S23*m*, it is required that the masks are prepared corresponding to the number of the branch paths and then printing is performed using materials different in resistivity. For that reason, in this method, the number of steps of the screen printing is increased. Accordingly, from the viewpoint that the heater can be manufactured using the same material for the respective branch paths, the constitution in this embodiment may desirably be employed.

In this embodiment, the widths of the branch paths arranged in the longitudinal direction of the substrate are changed for every branch path, but the constitution of the heater 600 is not limited thereto. When the branch paths including the branch path closer to the electrical contact and having a large resistance and the branch path more remote from the electrical contact and having a small resistance are provided so that the energization non-uniformity of the heat generating element 620 can be suppressed, the branch paths may also be used. For example, the widths of the branch paths may also be changed for every two branch paths. Specifically, such a constitution that the branch paths 652*b* and 652*c* have the same width and the branch paths 652*d* and 652*e* have the same width, which is broader than the width of the branch paths 652*b* and 652*c*, may also be employed.

Figure 11:
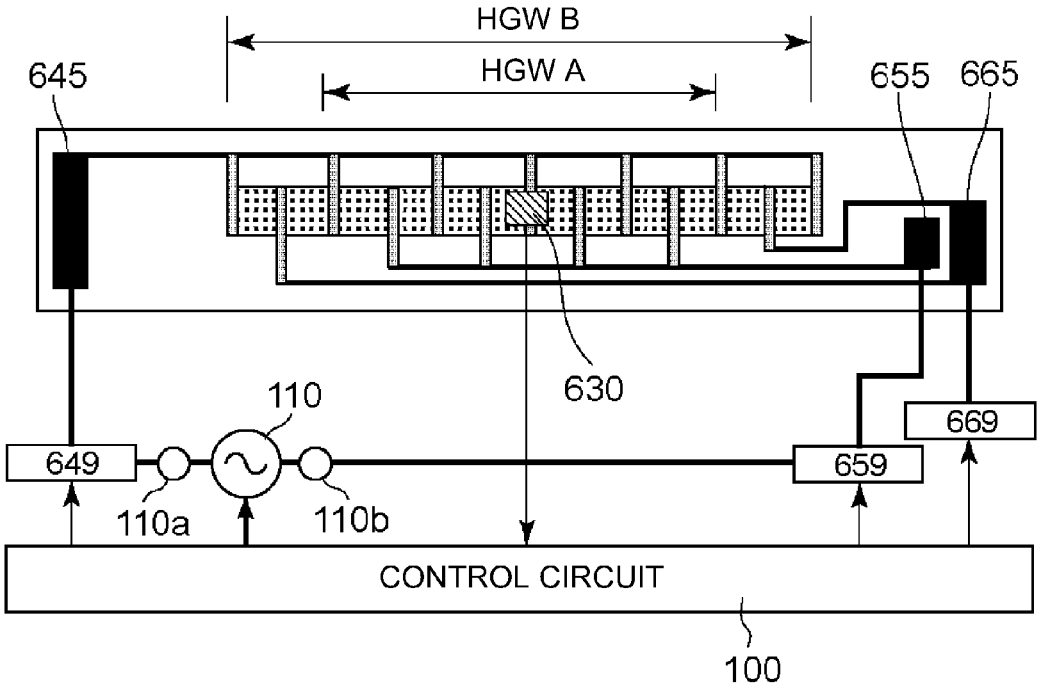
FIG. 11 is a schematic view for illustrating modified embodiment of the fixing device in Embodiment 1.

In this embodiment, the energization is effected from one longitudinal end side of the substrate 610 by using the constitution in which all the electrical contacts are disposed in one longitudinal end side of the substrate 610, but the constitution of the fixing device 40 is not limited thereto. In a constitution in which the energization is effected from a longitudinal end portion side, a heat generation non-uniformity can be generated in the heat generating element 620 due to the voltage drop of the electroconductor lines. FIG. 11 is a schematic view for illustrating a modified example of the fixing device 40. For example, as shown in FIG. 11, the fixing device 40 may also be used having a constitution in which the electrical contacts 655, 665 are disposed in a region obtained by extending the substrate 610 in the other longitudinal end portion side of the substrate 610, and then the electric power may be supplied to the heater 600 from both end portions of the substrate 610 with respect to the longitudinal direction. In such a case, the heat generation non-uniformity of the heat generating element 620 can be suppressed when the width and resistivity of each of the branch paths are appropriately determined. However, as in this embodiment, in the constitution in which all of the electrical contacts are disposed in one longitudinal end portion side of the substrate 610, the influence of the voltage drop in the electroconductor paths is large, and therefore the effect of suppressing the heat generation non-uniformity is remarkable.

Embodiment 2

Figure 12:
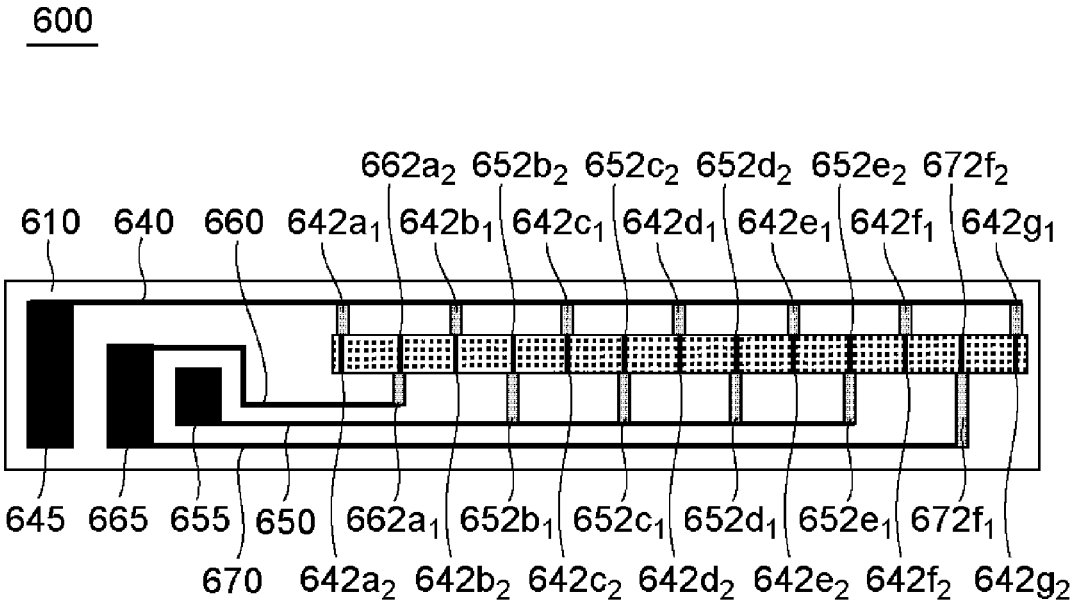
FIG. 12 is a schematic view for illustrating a heater in Embodiment 2.

The heater in Embodiment 2 will be described. FIG. 12 is a schematic view for illustrating a heater 600 in this embodiment. In Embodiment 1, the branch path resistance is adjusted by changing the width of the entire branch path. On the other hand, in this embodiment, the branch path resistance is adjusted by changing the width of a part of the branch path. Specifically, the resistance is adjusted by changing the width of the branch path at a portion from a contact point with the electroconductor path to a contact point with the heat generating element. By employing such a constitution, the width of the branch path at the contact portion with the heat generating element can be made constant among the respective branch paths. In addition, as the material for the contact portion of the branch path with the heat generating element, the same low-resistance material as the material for the electroconductor path can be used. For that reason, the local temperature lowering of the heat generating element due to the lamination between the heat generating element and the branch path during heat generation can be effectively suppressed compared with Embodiment 1. However, in this embodiment, the printing of the branch paths requires high accuracy, and therefore from the viewpoint of stable manufacturing of the heater 600, the constitution in Embodiment 1 may desirably be employed.

The constitution of the fixing device 40 in this embodiment is similar to the constitution in Embodiment 1, except for the constitution of the branch paths of the heater 600. For that reason, constituent elements similar to those in Embodiment 1 are represented by identical reference numerals or symbols and a detailed description thereof will be omitted.

As shown in FIG. 12, in this embodiment, for convenience, with respect to the respective branch paths, different names are adopted for every different portion. Specifically, of the electroconductor pattern printed on the substrate, portions extending from electroconductor paths 640, 650, 660, 670 toward the heat generating element 620 are called branch portions 642*a*1-642*g*1, 652*b*1-652*e*1, 662*a*1, 672*a*1 which are hereinafter referred to as $\mathbf{642}_1$, $\mathbf{652}_1$, $\mathbf{662}_1$, $\mathbf{672}_1$, respectively. In addition, of the electroconductor path pattern, portions connected with the heat generating element 620 in contact with the heat generating element 620 so as to cross the heat generating element 620 are called connecting portions (electrode portions) 642*a*2-642*g*2, 652*b*2-652*e*2, 662*a*2, 672*f*2 which are hereinafter referred to as $\mathbf{642}_2$, $\mathbf{652}_2$, $\mathbf{662}_2$, $\mathbf{672}_2$, respectively.

In this embodiment, the resistance between the electrical contact and the heat generating element 620 is calculated in the following manner.

First, the resistance value Ra of the electroconductor path from the electrical contact to the branch portion is calculated from the formula (1) similarly as in Embodiment 1. That is, the resistance Ra of the electroconductor path increases in value in proportional to the distance from the electrical contact to the branch portion.

The resistance Rb1 of each of the branch portions is calculated from the following formula. In the formula, a width (longitudinal direction of the substrate 610) of the branch portion is Wb1, the height is Hb1, the resistivity is pb1, and the length of the branch portion is Lb1.

$$Rb1=\rho b1\times Lb1/(Wb1\times Hb1) \quad (4)$$

The resistance Rb2, of each of the connecting portions, from a contact point of the branch portion with the connecting portion to another terminal of the connecting portion is calculated from the following formula. In the formula, the width (longitudinal direction of the substrate 610) of the connecting portion is Wb, the height is Hb2, the resistivity is pb2, and the length of the connecting portion is Lb2.

$$Rb2=\rho b2\times Lb2(Wb2\times Hb2) \quad (5)$$

Accordingly, the total resistance Rall which is the resistance from the electrical contact to an end portion (terminal) of the connecting portion is calculated from the following formula.

$$Rall=Ra+Rb1+R=\rho a\times La/(Wa\times Ha)+\rho b1\times Lb1/(Wb1\times Hb1)+\rho b2\times Lb2/(Wb2\times Hb2) \quad (6)$$

In this embodiment, as the material for the connecting portion, the same low-resistance material as the material for the electroconductor path is used, and is $1.6\times10^{-8}$ (Ω) and is resistivity ρb2. Thus, the heater 600 in this embodiment uses the low-resistance material as the material for the connecting portion, and therefore a difference in potential between the contact point of the branch portion with the connecting portion and another end of the connecting portion is small. For that reason, the heat generation distribution of the heat generating element 620 with respect to the widthwise direction easily becomes uniform compared with the heater in Embodiment 1. Further, the temperature distribution of the heat generating element 620 easily broadens on the basis of the neighborhood of the widthwise central portion. Incidentally, in this embodiment, in the neighborhood of the widthwise central portion of the heat generating element 620, the heater 600 stably contacts the fixing belt 603 with a large contact force. For that reason, in this embodiment, heat can be stably supplied to the fixing belt 603. The width Wb2 of the connecting portion is made uniform as 0.2 mm. This width is sufficiently narrow for suppressing the temperature non-uniformity of the heater 600 during the energization due to the lamination between the heat generating element 620 and the branch path. The length Lb2 of the connecting portion is 3 mm, which is equal to the widthwise width of the heat generating element 620*m* and the height Hb2 of the connecting portion is 35 μm, which is equal to the height of the electroconductor path. Accordingly, the resistance of each connecting portion is 0.015Ω.

On the other hand, in order to make uniform the path from the electrical contact to the connecting portion for each of the paths, the resistances of the respective branch portions are adjusted by changing the widths of the branch portions. In this embodiment, in order to effectively adjust the resistances of the respective branch portions, the material having a larger resistivity than the material for the electroconductor path is used for each branch portion. In this embodiment, as the material for the branch portions 642*a*1-642*g*1, a paste is used in which silver is mixed with palladium in an amount providing the resistivity of $2.7\times10^{-6}$Ω·m is used. In addition, as the material for the branch portions 652*b*1-652*e*1, 662*a*1, 672*a*1, a paste is used in which silver is mixed with palladium in an amount providing the resistivity of $3.3\times10^{-6}$Ω·m.

In this embodiment, the width of the branch portions is broader with an increasing distance (larger path) from the electrical contact. This is because a difference is provided between the resistances of the respective branch paths. However, in view of a manufacturing limit by the screen printing process, there is a need to provide the branch portion with the width of 0.1 mm or more. For that reason, the width of the branch portion 642*a*1 closest to the electrical contact 645 is 0.1 mm as a reference, and then the width of other branch portions 642*b*1-642*g*1 are determined.

Further, the width of the branch portion 662*a*1 closest to the electrical contacts 665, 655 is 0.1 mm as a reference, and then other branch portions 652*b*1-652*e*1, 672*f*1 are determined.

Constitutions of respective branch portions designed on the basis on the above description are shown in Table 3.

TABLE 3

| | Width Wb1 (mm) | Length Lb1 (mm) | Resistance Rb1 (Ω) |
|---|---|---|---|
| 642a1 | 0.100 | 0.3 | 0.499 |
| 642b1 | 0.118 | 0.3 | 0.423 |
| 642c1 | 0.142 | 0.3 | 0.349 |
| 642d1 | 0.183 | 0.3 | 0.272 |
| 642e1 | 0.250 | 0.3 | 0.199 |
| 642f1 | 0.400 | 0.3 | 0.125 |
| 642g1 | 1.000 | 0.3 | 0.050 |
| 662a1 | 0.100 | 0.3 | 0.606 |
| 652b1 | 0.495 | 1.3 | 0.520 |
| 652c1 | 0.575 | 1.3 | 0.457 |
| 652d1 | 0.690 | 1.3 | 0.380 |
| 652e1 | 0.855 | 1.3 | 0.307 |
| 672f1 | 2.000 | 2.3 | 0.232 |

Figure 13:
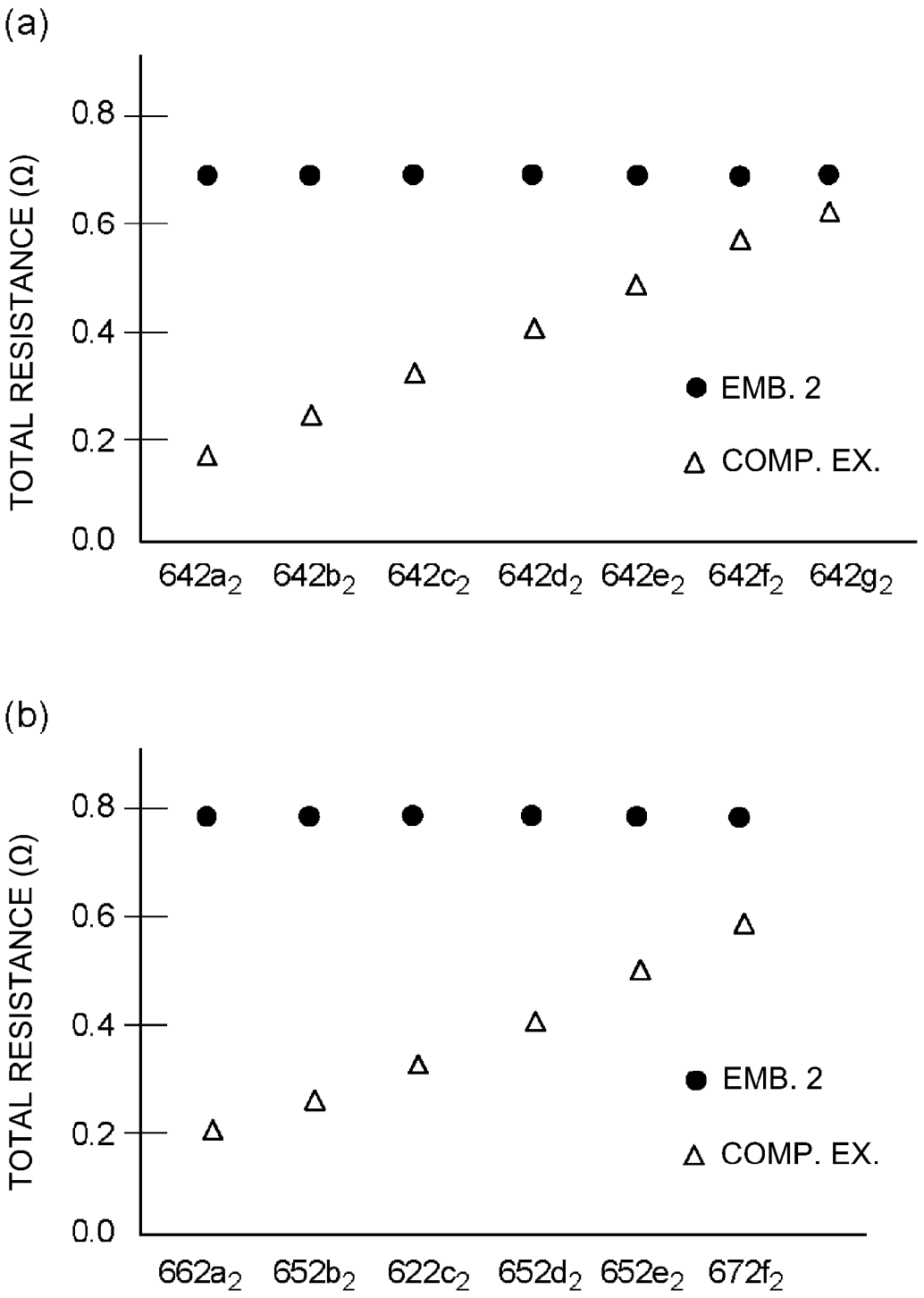
In FIG. 13, (a) is a graph showing a total resistance Rall in a path including a common branch path, and (b) is a graph showing a total resistance Rall in a path including an opposite branch path in Embodiment 2.

Between this embodiment and the Comparison Example, the total resistance Rall of the path from the electroconductor path to the heat generating element will be compared. In FIG. 13, (a) is a graph showing the total resistance Rall in the path including the common branch path 642. According to (a) of FIG. 13, it is understood that the total resistance Rall becomes larger with the path including the branch path 642 becoming more remote from the electrical contact. This is attributable to the difference in resistance value Ra due to a length of the path of the electroconductor path 640 connecting the electrical contact 645 with the branch line. Accordingly, the total resistance Rall in larger with the path connecting with the branch path becoming more remote from the electrical contact, and in the case where the voltage is applied to the electrical contact 645, the voltage applied to the heat generating element 620 decreases with a position becoming more remote from the electrical contact 645.

In FIG. 13, (b) is a graph showing the total resistance Rall in the path including the opposite branch path. According to (b) of FIG. 13, in the case of Comparison Example, it is understood that the total resistance becomes larger with the path connecting with the branch path, of the branch paths 652, 662, 672, becoming more remote from the electrical contact. Incidentally, in this case, the electroconductor paths 650, 660, 670 were formed to have the same width, the same height and the same resistivity. For that reason, in the case where the same voltage is applied to the electrical contact 655 and the electrical contact 665, the applied voltage of the connecting portion located at a position more remote from the electrical contact 655 and the electrical contact 665 decreases.

On the other hand, in this embodiment, as the material for the branch path, a material is used having a larger resistivity than the material for the electroconductor path, and the width of the branch path is made narrower with a position closer to the electrical contact. For that reason, as shown in (a) of FIG. 13 and (b) of FIG. 13, the values of the total resistance Rall in all of the common branch paths 642 can be made uniform substantially at the same value. Similarly, the values of the total resistance Rall in all of the opposite branch paths can be made uniform substantially at the same value.

In the case of this embodiment, the heat generation amounts of the respective sections of the heat generating element 620 of the heater 600 are uniform, and therefore the temperature of the fixing belt 603 is uniform at 195° C. with respect to the longitudinal direction. For that reason, in the case where the image is fixed using the fixing belt 603 heated by the heater 600 in this embodiment, it is possible to output a high-quality image for which the uneven glossiness is suppressed.

Accordingly, according to this embodiment, it is possible to suppress the non-uniformity of the energization to the heat generating element 620 generated due to the difference in length of the electroconductor path having the resistance. Further, the temperature non-uniformity of the heater 600 with respect to the longitudinal direction can be suppressed. Accordingly, it is possible to suppress the uneven glossiness of the image when the image on the sheet is heated in the fixing device 40.

Figure 17:
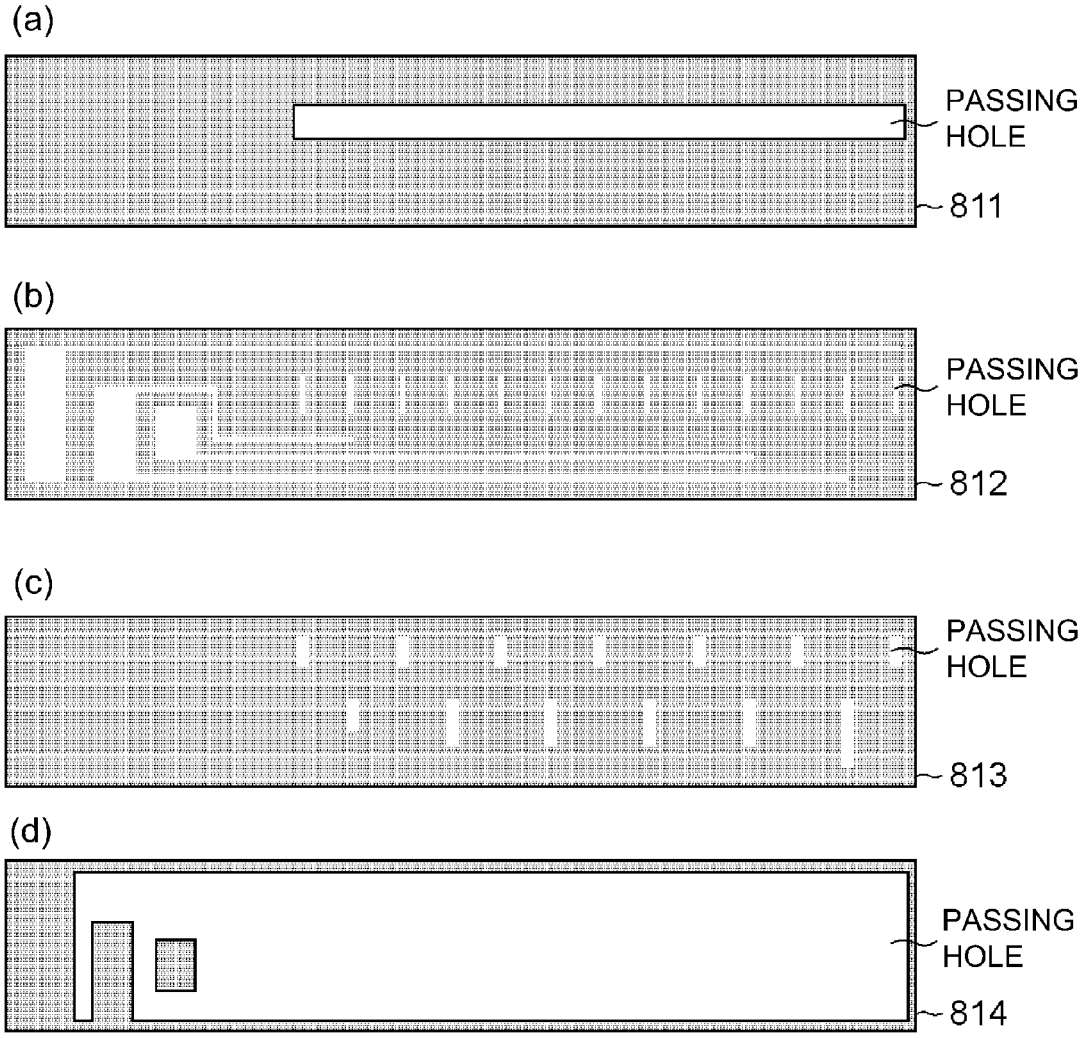
In FIG. 17, (a) to (d) are schematic views showing a plate used for manufacturing the heater in Embodiment 2.
Figure 18:
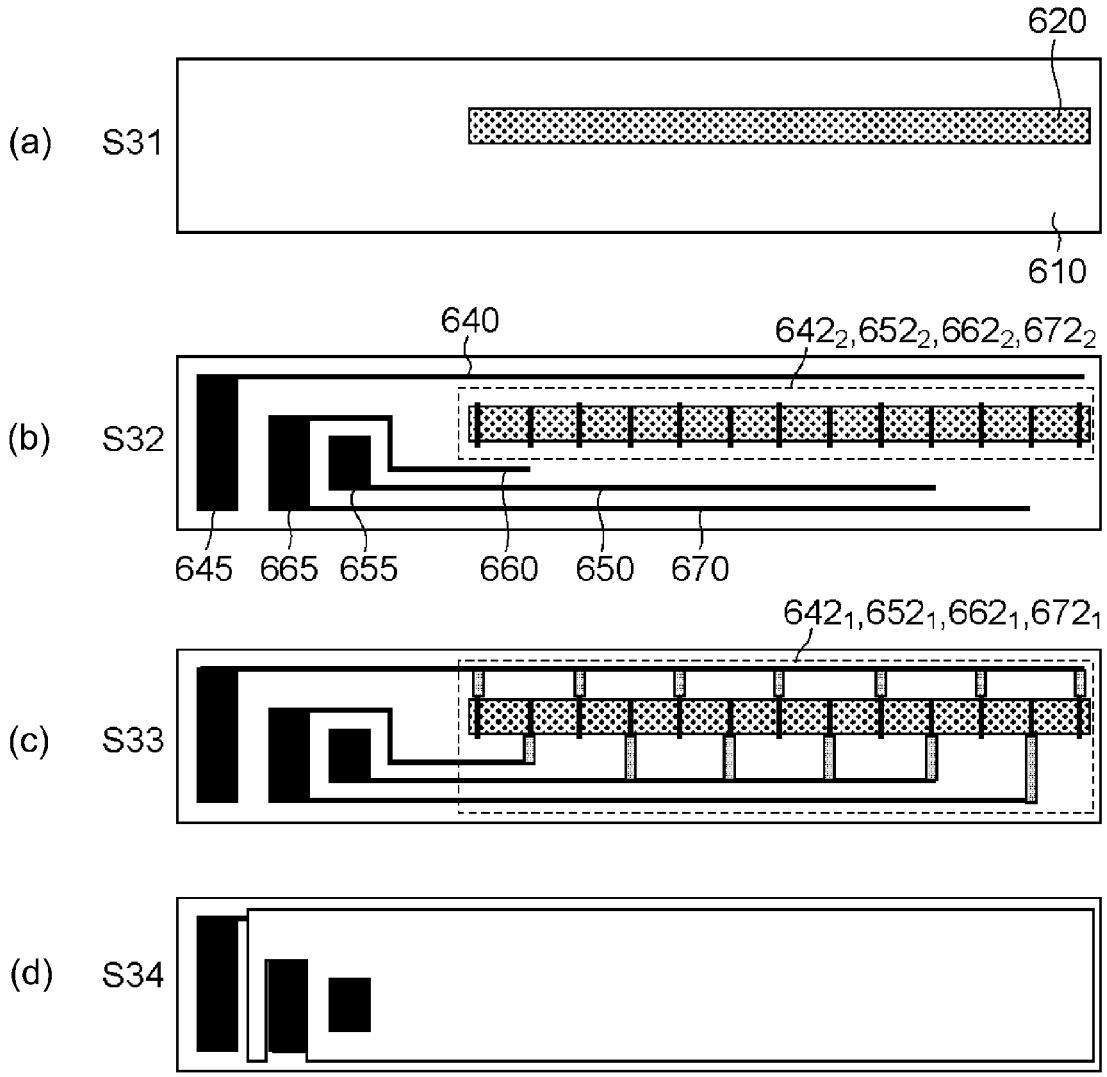
In FIG. 18, (a) to (d) are schematic views for illustrating manufacturing steps of the heater in Embodiment 2.

A manufacturing method of a ceramic heater using a thick film printing method (screen printing) will be described. In FIG. 17, (a) to (d) are schematic views showing structures of plates 811, 812, 813, 814, respectively, used for manufacturing the heater 600 in Embodiment 2. In FIG. 18, (a) to (d) are schematic views for illustrating the manufacturing steps of the heater 600 in this embodiment.

In the steps of subjecting the substrate 610 to the screen printing, plates (mesh plates, metal masks plates) as shown in FIG. 17 are used. The plate 811 is a member for printing the heat generating element 620 on the substrate. The plate 811 is provided with a passing hole through which the material paste is passable so that the heat generating element 620 is printed in a desired shape. The plate 812 is a member for printing the electroconductor patterns of the electrical contacts 645, 655, 665, the electroconductor paths 640, 650, 660, 670, and the connecting portions $\mathbf{642}_2$, $\mathbf{652}_2$, $\mathbf{662}_2$, $\mathbf{672}_2$ (electrodes) on the substrate. The plate 812 is provided with passing holes through which the material paste is passable so that the electroconductor patterns are printed in desired shapes.

The plate 813 is a member for printing the branch portions $\mathbf{642}_1$, $\mathbf{652}_1$, $\mathbf{662}_1$, $\mathbf{672}_1$, on the substrate. The plate 813 is provided with passing holes through which the material paste is passable so that the branch portions $\mathbf{642}_1$, $\mathbf{652}_1$, $\mathbf{662}_1$, $\mathbf{672}_1$ are printed in desired shapes. The plate 814 is a member for printing the coat layer 680 on the substrate. The plate 814 is provided with a passing hole through which the material paste is passable so that the coat layer 690 is printed in a desired shape.

In this embodiment, the heater 600 is manufactured by a procedure as shown in FIG. 18. First, the heat generating element 620 is formed on the substrate 610 (S31) ((a) of FIG. 18). Specifically, the substrate 610 and the plate 811 are (positionally) aligned with each other, and thereafter a high-resistance material paste is applied onto the substrate 610 through the plate 802. Thus, the heat generating element 620 having a desired dimension is printed on the substrate 610. Thereafter, the substrate 610 on which the heat generating element 620 (lower layer) is placed is baked at high temperature. Then, on the substrate 610 on which the heat generating element 620 is formed, electroconductor patterns (645, 655, 665, 640, 650, 660, 670, $\mathbf{642}_2$, $\mathbf{652}_2$, $\mathbf{652}_2$, $\mathbf{662}_2$, $\mathbf{672}_2$) are formed (S32) ((b) of FIG. 18). Specifically, after alignment between the substrate 610 and the plate 812 is made, a low-resistance material paste is applied onto the substrate 610 through the plate 801. Thus, the electroconductor pattern having a desired shape is printed on the substrate 610. Thereafter, the substrate 610 on which the heat generating element 620 and the electroconductor pattern are placed is baked at a high temperature.

Then, the branch portions $\mathbf{642}_1$, $\mathbf{652}_1$, $\mathbf{662}_1$, $\mathbf{672}_1$ are formed on the substrate 610 on which the electroconductor patterns and the heat generating element 620 are formed (S33) ((c) of FIG. 18). Specifically, after alignment between the substrate 610 and the plate 813, a medium-resistance material paste is applied onto the substrate 610 through the plate 802. Thus, the branch portions having a shape of a desired shape are printed on the substrate 610. Thereafter, the substrate 610 on which the electroconductor patterns, the heat generating element 620 and the branch path portions are placed is baked at a high temperature.

Then, on the substrate 610 on which the various printing steps are performed, an insulating coat layer 680 for effecting electrical, mechanical and chemical protection is formed (S34) ((d) of FIG. 18). Specifically, after alignment between the substrate 610 and the plate 814, a glass paste is applied onto the substrate 610 through the plate 803. Thus, the coat layer 680 having a desired shape is printed on the substrate 610. Thereafter, the substrate 610 on which the heat generating element 620, the electroconductor pattern and the coat layer 680 are places is baked at a high temperature.

In this embodiment, the resistivity of the branch portion is made larger than the resistivity of the electroconductor path and the widths of the branch portions are made different from each other, but the method of adjusting the resistances of the branch portions is not limited thereto. If a method is capable of adjusting the branch portion resistance, the method may also be used. For example, the branch portion resistance may also be adjusted only by a change in width of the branch portion while the resistivity of the branch portion and the resistivity of the electroconductor path are kept in an equal state. However, from the viewpoint that the enlargement in size of the branch portion can be suppressed, the heater 600 may desirably employ the constitution in this embodiment.

For example, the branch portion resistance may be adjusted by changing the resistivity of the respective branch paths while keeping the width of the branch paths at a constant level. However, in the case where materials different in resistivity are used for the respective branch portions, in the manufacturing method using the screen printing process, the number of steps increases. Specifically, it is required that the masks are prepared corresponding to the number of the different resistance materials and then printing of the branch portions is made in separate steps. For that reason, from the viewpoint that the heater can be manufactured using the same material for the respective branch portions 642*a*-642*g*, in the same step, the constitution in this embodiment may desirably be employed. Similarly, from the viewpoint that the branch portions 652*b*-652*e*, 662*a*, 672*f* can be printed using the same material in the same step, the constitution in this embodiment may desirably be employed.

In this embodiment, the widths of the branch portions are changed every branch path, but the constitution of the heater 600 is not limited thereto. When the branch paths including the branch path closer to the electrical contact and having a large resistance and the branch path more remote from the electrical contact and having a small resistance are provided so that the energization non-uniformity of the heat generating element 620 can be suppressed, the branch paths may also be used. For example, the widths of the branch paths may also be changed every two branch paths. Specifically, such a constitution that the branch paths 652*b* and 652*c* have the same width and the branch paths 652*d* and 652*e* have the same width which is broader than the width of the branch paths 652*b* and 652*c* may also be employed.

In this embodiment, as the material for the connecting portions $\mathbf{462}_2$, $\mathbf{652}_2$, $\mathbf{662}_2$, $\mathbf{672}_2$, the same low-resistance material as the material for the electroconductor paths and the like is used, but similarly as in the case of the branch portions $\mathbf{642}_1$, $\mathbf{652}_1$, $\mathbf{662}_1$, $\mathbf{672}_1$, the medium-resistance material may also be used. That is, the connecting portions and the branch portions may also be integrally printed using a mask provided with passing holes so that the connecting portions are narrower than the branch portions.

Other Embodiments

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples, which are based on the sheets P being fed with the center thereof aligned with the center of the fixing device 40, but the sheets P may also be supplied on another sheet feeding basis of the fixing device 40. For that reason, e.g., in the case where the sheet feeding basis is an end(-line) feeding basis, the heat generating regions of the heater 600 may be modified so as to satisfy the condition in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, but expands at one of the opposite end portions.

The heater 600 is not limited to the heater having only the structure in which the branch paths are laminated on the heat generating element 620. For example, the branch paths may also be formed on the substrate and thereon, the heat generating element 620 may also be formed.

In the heaters in Embodiments 1 and 2, a constitution in which only two regions consisting of the heat generating regions A and B are provided is employed, but the applied range of the present invention is not limited to this constitution. The present invention is also applicable to a constitution in which heat generating regions have three or more patterns are provided.

The number of the electrical contacts limited to three or four. For example, five or more electrical contacts may also be provided depending on the number of heat generating patterns required for the fixing device.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1 and 2 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example, which are prepared by adding necessary device, equipment and casing structure.

The image heating apparatus is not limited to the fixing device for fixing a toner image on a sheet P. It may be a device for fixing a semi-fixed toner image into a completely fixed image, or a device for heating an already fixed image. Therefore, the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-191456 filed on Sep. 19, 2014, which is hereby incorporated by reference herein in its entirety.

What is claimed is:

1. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a plurality of electrode portions provided on said substrate and arranged with gaps in a longitudinal direction of said substrate;

a plurality of electrical contact portions provided on said substrate and electrically connectable with the energy supplying portion;

a plurality of heat generating portions provided between adjacent ones of said electrode portions so as to electrically connect between adjacent electrode portions, said heat generating portions being capable of generating heat by the electric power supply between adjacent electrode portions; and a plurality of electroconductive line portions provided on said substrate and connecting with said electrical contact portions and said electrode portions so that said electrode portions include first group electrode portions which are connectable with the first terminal and second group electrode portions which are connectable with the second terminal, said first group electrode portions and said second group electrode portions being arranged alternately in the longitudinal direction, wherein said plurality of electroconductive line portions comprise, a main line portion provided on said substrate and extending from said electrical contact portions in the longitudinal direction, a first branch line portion provided on said substrate and branching from said main line portion so as to electrically connect with a first electrode portion of said first group electrode portions, and a second branch line portion provided on said substrate and branching from said main line portion so as to electrically connect with a second electrode portion of said first group electrode portions, wherein said second electrode portion is spaced farther from said electrical contact portions than said first electrode portion in the longitudinal direction, and the electric resistance of said first branch line portion is larger than the electric resistance of said second branch line portion.

2. A heater according to claim 1, wherein the resistivity of said first branch line and the resistivity of said second branch line are substantially the same.

3. A heater according to claim 1, wherein the width of said first branch line is narrower than the width of said second branch line.

4. A heater according to claim 3, wherein the resistivity of a material used for each of said first branch line and said second branch line is larger than the resistivity of a material used for said main line portion.

5. A heater according to claim 3, wherein the width of said second branch line is broader than the width of said second electrode portion.

6. A heater according to claim 3, wherein the material and width of said first electrode portion is the same as said first branch line, and the material and width of said second electrode portion is the same as second branch line.

7. A heater according to claim 1, wherein said electrical contact portions are provided outside said plurality of heat generating portions in one end side with respect to the longitudinal direction.

8. A heater according to claim 1, wherein said plurality of electroconductive line portions further comprise, another main line portion provided on said substrate and extending from said electrical contact portions in the longitudinal direction, a third branch line portion provided on said substrate and branching from said another main line portion so as to electrically connect with a third electrode portion of said second group electrode portions, and a fourth branch line portion provided on said substrate and branching from said another main line portion so as to electrically connect with a fourth electrode portion of said second group electrode portions, wherein said fourth electrode portion is spaced farther from said electrical contact portions than said third electrode portion in the longitudinal direction, and the electric resistance of said third branch line portion is larger than the electric resistance of said fourth branch line portion.

9. A heater according to claim 8, wherein said plurality of electrical contact portions include, a first electrical contact provided on said substrate and electrically connectable with the first terminal, and a plurality of second electrical contacts provided on said substrate and electrically connectable with the second terminal, wherein said main line portion extends from said first electrical contact in the longitudinal direction, and said another main line portion extends from said second electrical contacts in the longitudinal direction.

10. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a plurality of electrode portions provided on said substrate and arranged with gaps in a longitudinal direction of said substrate;

a plurality of heat generating portions provided between adjacent ones of said electrode portions so as to electrically connect between adjacent electrode portions, said heat generating portions being capable of generating heat by the electric power supply between adjacent electrode portions;

a first electrical contact provided on said substrate and electrically connectable with the first terminal;

a plurality of second electrical contacts provided on said substrate and electrically connectable with the second terminal; and a plurality of electroconductive line portions provided on said substrate and connecting each of said plurality of electrode portions with an associated one of said first electrical contact and said plurality of second electrical contacts so that the electrode portions connected with said first electrical contacts and the electrode portions connected with said second electrical contacts are arranged alternately in the longitudinal direction, wherein said plurality of electroconductive line portions comprise, a main line portion provided on said substrate and extending from said first electrical contact in the longitudinal direction, a first branch line portion provided on said substrate and branching from said main line portion so as to electrically connect with a first electrode portion of said electrode portions connecting with said first electrical contact, and a second branch line portion provided on said substrate and branching from said main line portion so as to electrically connect with a second electrode portion of said electrode portions connecting with said first electrical contact, wherein said second electrode portion is spaced farther from said electrical contact portions than said first electrode portion in the longitudinal direction, and the electric resistance of said first branch line portion is larger than the electric resistance of said second branch line portion.

11. A heater according to claim 10, wherein the resistivity of said first branch line and the a resistivity of said second branch line are substantially the same.

12. A heater according to claim 10, wherein the width of said first branch line is narrower than the width of said second branch line.

13. A heater according to claim 12, wherein the resistivity of a material used for each of said first branch line and said second branch line is larger than the resistivity of a material used for said main line portion.

14. A heater according to claim 12, wherein the width of said second branch line is broader than the width of said second electrode portion.

15. A heater according to claim 12, wherein the material and width of said first electrode portion is the same as said first branch line, and the material and width of said second electrode portion is the same as said second branch line.

16. A heater according to claim 10, wherein said first electrical contact is provided outside said plurality of heat generating portions in one end side with respect to the longitudinal direction.

17. A heater according to claim 10, wherein said plurality of electroconductive line portions further comprise, another main line portion provided on said substrate and extending from predetermined electrical contacts of said second electrical contacts in the longitudinal direction, a third branch line portion provided on said substrate and branching from said another main line portion so as to electrically connect with a third electrode portion of said second group electrode portions, and a fourth branch line portion provided on said substrate and branching from said another main line portion so as to electrically connect with a fourth electrode portion of said second group electrode portions, wherein said fourth electrode portion is spaced farther from said predetermined electrical contacts than said third electrode portion in the longitudinal direction, and the electric resistance of said third branch line portion is larger than the electric resistance of said fourth branch line portion.

18. An image heating apparatus comprising:

an electric energy supplying portion provided with a first terminal and a second terminal;

a belt configured to heat an image on a sheet;

a substrate provided inside said belt and extending in a widthwise direction of said belt;

a plurality of electrode portions provided on said substrate and arranged with gaps in a longitudinal direction of said substrate;

a plurality of electrical contact portions provided on said substrate and electrically connectable with the energy supplying portion;

a plurality of heat generating portions provided between adjacent ones of said electrode portions so as to electrically connect between adjacent electrode portions, said heat generating portions being capable of generating heat by the electric power supply between adjacent electrode portions; and a plurality of electroconductive line portions provided on said substrate and connecting with said electrical contact portions and said electrode portions so that said electrode portions includes first group electrode portions which are connectable with the first terminal and second group electrode portions which are connectable with the second terminal, said first group electrode portions and said second group electrode portions being arranged alternately in the longitudinal direction, wherein said plurality of electroconductive line portions comprise, a main line portion provided on said substrate and extending from said electrical contact portions in the longitudinal direction, a first branch line portion provided on said substrate and branching from said main line portion so as to electrically connect with a first electrode portion of said first group electrode portions, and a second branch line portion provided on said substrate and branching from said main line portion so as to electrically connect with a second electrode portion of said first group electrode portions, wherein said second electrode portion is spaced farther from said electrical contact portions than said first electrode portion in the longitudinal direction, and the electric resistance of said first branch line portion is larger than the electric resistance of said second branch line portion.

19. An image heating apparatus according to claim 18, wherein the resistivity of said first branch line and the resistivity of said second branch line are substantially the same.

20. An image heating apparatus according to claim 18, wherein the width of said first branch line is narrower than the width of said second branch line.

21. An image heating apparatus according to claim 20, wherein the resistivity of a material used for each of said first branch line and said second branch line is larger than the resistivity of a material used for said main line portion.

22. An image heating apparatus according to claim 20, wherein the width of said second branch line is broader than the width of said second electrode portion.

23. An image heating apparatus according to claim 20, wherein the material and width of said first electrode portion is the same as said first branch line, and the material and width of said second electrode portion is the same as second branch line.

24. An image heating apparatus according to claim 18, wherein said electrical contact portions are provided outside said plurality of heat generating portions in one end side with respect to the longitudinal direction.

25. An image heating apparatus according to claim 18, wherein said plurality of electroconductive line portions further comprise, another main line portion provided on said substrate and extending from said electrical contact portion in the longitudinal direction, a third branch line portion provided on said substrate and branching from said another main line portion so as to electrically connect with a third electrode portion of said second group electrode portions, and a fourth branch line portion provided on said substrate and branching from said another main line portion so as to electrically connect with a fourth electrode portion of said second group electrode portions, wherein said fourth electrode portion is spaced farther from said electrical contact portions than said third electrode portion in the longitudinal direction, and the electric resistance of said third branch line portion is larger than the an electric resistance of said fourth branch line portion.

26. An image heating apparatus according to claim 25, wherein said plurality of electrical contact portions includes, a first electrical contact provided on said substrate and electrically connectable with the first terminal, and a plurality of second electrical contacts provided on said substrate and electrically connectable with the second terminal, wherein said main line portion extends from said first electrical contact in the longitudinal direction, and said another main line portion extends from said plurality of second electrical contacts in the longitudinal direction.

27. An image heating apparatus comprising:

an electric energy supplying portion provided with a first terminal and a second terminal;

a belt configured to heat an image on a sheet;

a substrate provided inside said belt and extending in a widthwise direction of said belt;

a plurality of electrode portions provided on said substrate and arranged with gaps in a longitudinal direction of said substrate;

a plurality of heat generating portions provided between adjacent ones of said electrode portions so as to electrically connect between adjacent electrode portions, said heat generating portions being capable of generating heat by the electric power supply between adjacent electrode portions;

a first electrical contact provided on said substrate and electrically connectable with the first terminal;

a plurality of second electrical contacts provided on said substrate and electrically connectable with the second terminal; and a plurality of electroconductive line portions provided on said substrate and connecting each of said plurality of electrode portions with an associated one of said first electrical contact and said plurality of second electrical contacts so that the electrode portions connected with said first electrical contact and the electrode portions connected with said second electrical contact are arranged alternately in the longitudinal direction, wherein said plurality of electroconductive line portions comprise, a main line portion provided on said substrate and extending from said first electrical contact in the longitudinal direction, a first branch line portion provided on said substrate and branching from said main line portion so as to electrically connect with a first electrode portion of said electrode portions connecting with said first electrical contact, and a second branch line portion provided on said substrate and branching from said main line portion so as to electrically connect with a second electrode portion of said electrode portions connecting with said first electrical contact, wherein said second electrode portion is spaced farther from said electrical contact portions than said first electrode portion in the longitudinal direction, and the electric resistance of said first branch line portion is larger than the electric resistance of said second branch line portion.

28. An image heating apparatus according to claim 27, wherein the resistivity of said first branch line and the resistivity of said second branch line are substantially the same.

29. An image heating apparatus according to claim 27, wherein the width of said first branch line is narrower than the width of said second branch line.

30. An image heating apparatus according to claim 29, wherein the a resistivity of a material used for each of said first branch line and said second branch line is larger than the resistivity of a material used for said main line portion.

31. An image heating apparatus according to claim 29, wherein the width of said second branch line is broader than the width of said second electrode portion.

32. An image heating apparatus according to claim 29, wherein the material and width of said first electrode portion is the same as said first branch line, and the material and width of said second electrode portion is the same as second branch line.

33. An image heating apparatus according to claim 27, wherein said first electrical contact is provided outside said plurality of heat generating portions in one end side with respect to the longitudinal direction.

34. An image heating apparatus according to claim 27, wherein said electrode portions include first group electrode portions which are connectable with the first terminal and second group electrode portions which are connectable with the second terminal, wherein said plurality of electroconductive line portions further comprise, another main line portion provided on said substrate and extending from predetermined electrical contacts of said second electrical contacts in the longitudinal direction, a third branch line portion provided on said substrate and branching from said another main line portion so as to electrically connect with a third electrode portion of said second group electrode portions, and a fourth branch line portion provided on said substrate and branching from said another main line portion so as to electrically connect with a fourth electrode portion of said second group electrode portions, wherein said fourth electrode portion is spaced farther from said predetermined electrical contacts than said third electrode portion in the longitudinal direction, and the electric resistance of said third branch line portion is larger than the electric resistance of said fourth branch line portion.

* * * * *